US008833356B2

(12) United States Patent
Khoshnood

(10) Patent No.: US 8,833,356 B2
(45) Date of Patent: Sep. 16, 2014

(54) BOW STABILIZING SYSTEMS AND METHODS

(76) Inventor: Bahram Khoshnood, Cumming, GA (US)

( * ) Notice: Subject to any disclaimer, the term of this patent is extended or adjusted under 35 U.S.C. 154(b) by 584 days.

(21) Appl. No.: 13/153,438

(22) Filed: Jun. 5, 2011

(65) Prior Publication Data

US 2012/0125310 A1 May 24, 2012

Related U.S. Application Data

(63) Continuation-in-part of application No. 12/983,919, filed on Jan. 4, 2011, now Pat. No. 8,573,193, which is a continuation-in-part of application No. 12/950,995, filed on Nov. 19, 2010, now Pat. No. 8,590,522.

(51) Int. Cl.
*F41B 5/20* (2006.01)
*F41B 5/14* (2006.01)

(52) U.S. Cl.
CPC ..... *F41B 5/1426* (2013.01)
USPC ..... 124/89; 124/86; 124/88

(58) Field of Classification Search
CPC ..... F41B 5/1426
USPC ..... 124/86, 88, 89
See application file for complete search history.

(56) References Cited

U.S. PATENT DOCUMENTS 3,342,172 A * 9/1967 Sanders ..... 124/23.1
3,670,712 A * 6/1972 Izuta ..... 124/89
4,085,832 A * 4/1978 Gaines et al. ..... 188/268
4,491,123 A * 1/1985 Wirtz ..... 124/89
4,570,608 A * 2/1986 Masterfield ..... 124/89
4,893,606 A * 1/1990 Sisko ..... 124/89
5,016,602 A * 5/1991 Mizek ..... 124/89
5,273,022 A * 12/1993 Leven ..... 124/89
5,339,793 A * 8/1994 Findley ..... 124/89
5,370,104 A * 12/1994 Neie ..... 124/89
5,388,563 A * 2/1995 Hsu ..... 124/23.1
5,411,009 A * 5/1995 Thompson et al. ..... 124/89
5,460,156 A * 10/1995 Sappington ..... 124/89
5,511,533 A * 4/1996 Waller ..... 124/89
5,595,169 A * 1/1997 Brown, Jr. ..... 124/89
5,611,325 A * 3/1997 Kudlacek ..... 124/89
5,669,370 A * 9/1997 Breedlove ..... 124/89
5,735,257 A * 4/1998 Walk ..... 124/89
5,934,266 A * 8/1999 Martin et al. ..... 124/88
5,975,070 A * 11/1999 Sands ..... 124/89
5,992,403 A * 11/1999 Slates ..... 124/89
6,021,770 A * 2/2000 Sodaro ..... 124/89
6,085,736 A * 7/2000 Osterhues ..... 124/89
6,092,516 A * 7/2000 Martin et al. ..... 124/88
6,382,201 B1 * 5/2002 McPherson et al. ..... 124/89
6,526,957 B1 * 3/2003 Leven ..... 124/89
6,588,414 B2 * 7/2003 McMillan, III ..... 124/89
6,675,793 B1 * 1/2004 Saunders ..... 124/89

(Continued)

*Primary Examiner* — Gene Kim
*Assistant Examiner* — Alexander Niconovich
(74) *Attorney, Agent, or Firm* — Brient Globerman LLC

(57) ABSTRACT

A weapon stabilizing and shock dampening assembly according to various embodiments comprises: (1) a dampener support; (2) an elongated housing that is adapted for supporting the dampener support; and (3) an attachment mechanism that is adapted for selectively attaching the elongated housing adjacent a weapon (e.g., a bow). The dampener support may be attached (e.g., slideably attached) adjacent the elongated housing so that a user may selectively move (e.g., slide) the dampener support relative to the elongated housing to thereby adjust a distance between the weapon and a dampener that is supported by the dampener support.

15 Claims, 26 Drawing Sheets

(56) References Cited

U.S. PATENT DOCUMENTS

| | | | | |
|---|---|---|---|---|
| 6,712,059 | B2 * | 3/2004 | Donovan | 124/89 |
| 6,718,964 | B1 * | 4/2004 | Graf | 124/89 |
| 6,817,352 | B1 * | 11/2004 | Saunders | 124/89 |
| 7,290,644 | B2 * | 11/2007 | Miyake | 188/379 |
| 7,793,645 | B2 * | 9/2010 | Walk et al. | 124/89 |
| 7,954,481 | B2 * | 6/2011 | Barnard | 124/88 |
| 8,141,548 | B2 * | 3/2012 | Leven | 124/89 |
| 8,225,778 | B2 * | 7/2012 | Walk et al. | 124/89 |
| 2002/0104526 | A1 * | 8/2002 | Chipman | 124/89 |
| 2003/0226556 | A1 * | 12/2003 | Leven | 124/89 |
| 2006/0180135 | A1 * | 8/2006 | Andrews | 124/89 |
| 2006/0283435 | A1 * | 12/2006 | Pellerite | 124/89 |
| 2008/0264400 | A1 * | 10/2008 | Wright | 124/89 |
| 2009/0133683 | A1 * | 5/2009 | Wright | 124/89 |
| 2011/0120440 | A1 * | 5/2011 | Stokes | 124/89 |
| 2011/0259313 | A1 * | 10/2011 | Reinhold | 124/89 |

* cited by examiner

BOW STABILIZING SYSTEMS AND METHODS

CROSS-REFERENCE TO RELATED APPLICATIONS

This application is a continuation-in-part of U.S. patent application Ser. No. 12/983,919 entitled "Bow Stabilizing Systems and Methods", which was filed on Jan. 4, 2011, now U.S. Pat. No. 8,573,193 which is a continuation-in-part of U.S. patent application Ser. No. 12/950,995 entitled "Bow Stabilizing and Shock Dampening Systems and Methods", which was filed on Nov. 19, 2010; now U.S. Pat. No. 8,590,522 both of which are hereby incorporated herein by reference in their entirety.

BACKGROUND

Bow stabilizers are used to help hold an archer's bow steady throughout the shot cycle. A typical current bow stabilizer is simply a piece of metal (or other weight) that is attached to the front of a bow. Although such stabilizers can be useful in reducing rotation in the bow through the shot cycle, there is currently a need for improved stabilizers that are adapted for: (1) further reducing rotation in the bow through the shot cycle; (2) reducing torque on the archer's grip through the shot cycle; (3) dampening vibration; (4) reducing the noise generated during the shot cycle; and/or (5) allowing a user to easily adjust the performance of the stabilizer.

SUMMARY

A bow stabilizing and shock dampening assembly according to various embodiments comprises: (1) a dampener support; (2) an elongated housing that is adapted for supporting the dampener support; and (3) an attachment mechanism that is adapted for selectively attaching the elongated housing adjacent a bow, wherein the dampener support is slideably attached adjacent the elongated housing so that a user may selectively slide the dampener support relative to the elongated housing to thereby adjust the distance between the bow and a dampener that is supported by the dampener support.

A weapon stabilizing and shock dampening assembly according to a further embodiment comprises: (1) a dampener support assembly; and (2) a rack that is adapted for supporting the dampener support assembly adjacent a weapon, wherein the rack and dampener support assembly are adapted to allow a user to slide the dampener support assembly relative to the rack, and to thereby modify a distance between the weapon and a dampener supported by the dampener support assembly.

A method of stabilizing and reducing the shock in a weapon, according to various embodiments, comprises: (1) providing an elongated dampener assembly support that is adapted to be attached adjacent the weapon; and (2) providing a dampener assembly that is adapted to be slideably attached to the elongated dampener assembly support, so that a user may selectively slide the dampener assembly relative to the elongated dampener assembly support and thereby modify a distance between the weapon and a dampener within the dampener assembly.

BRIEF DESCRIPTION OF THE DRAWINGS

Figure 1:
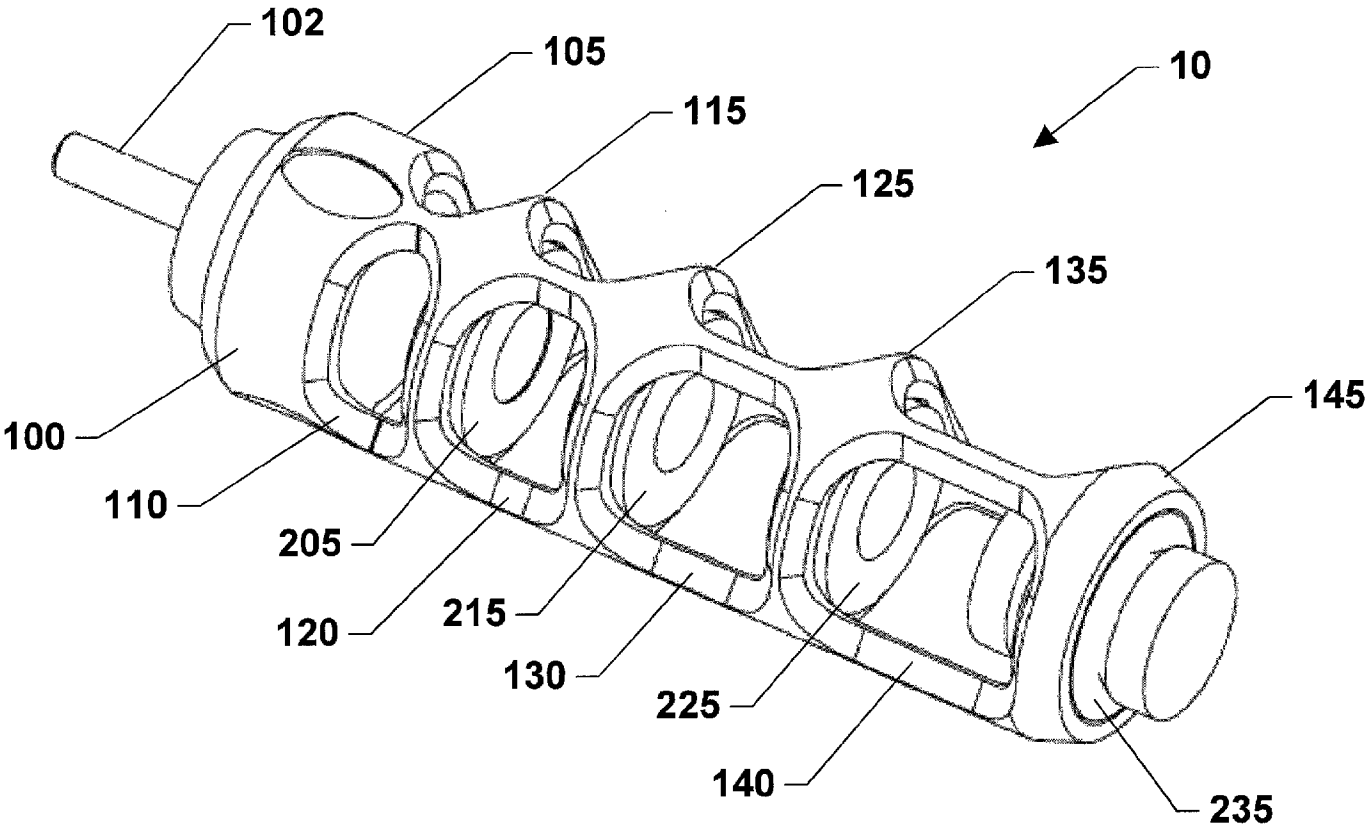
Figure 2:
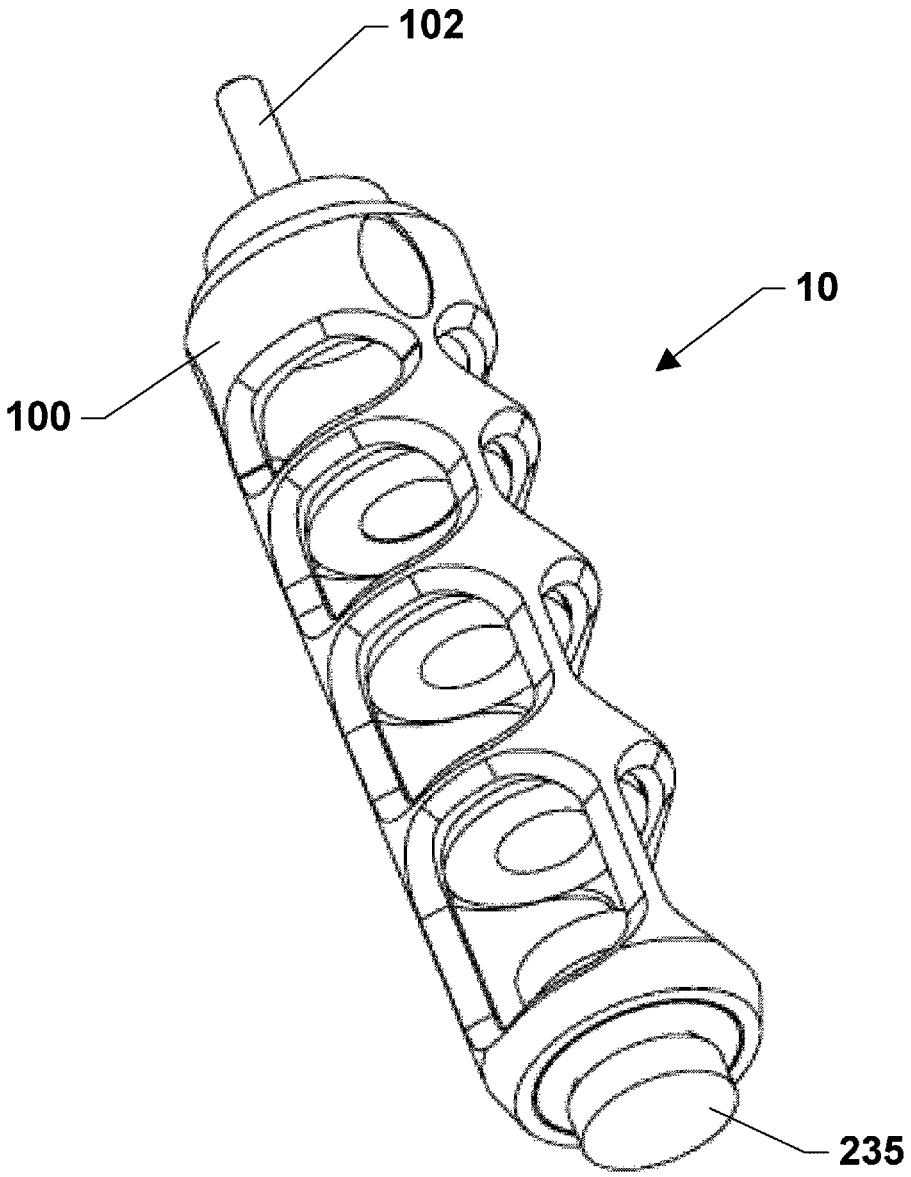
Figure 3:
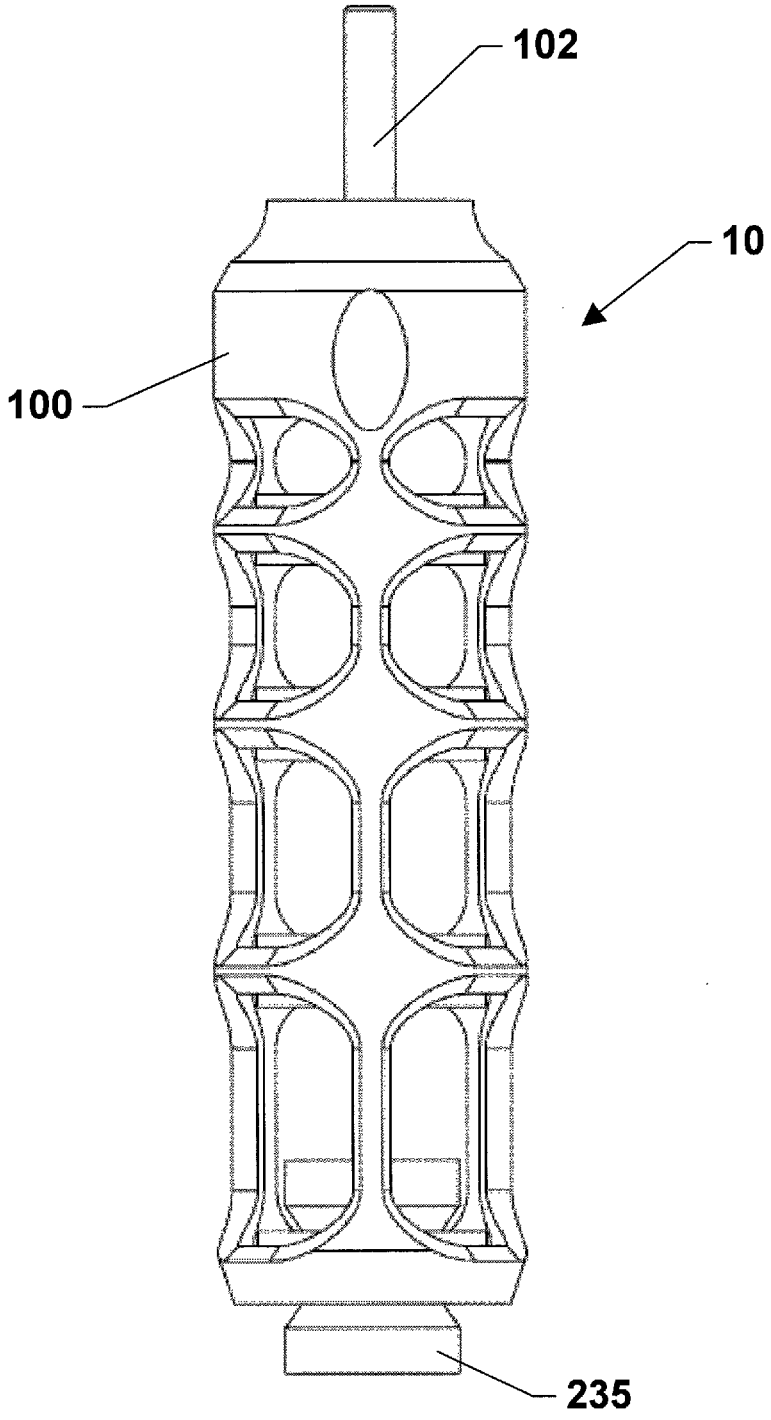
Figure 4:
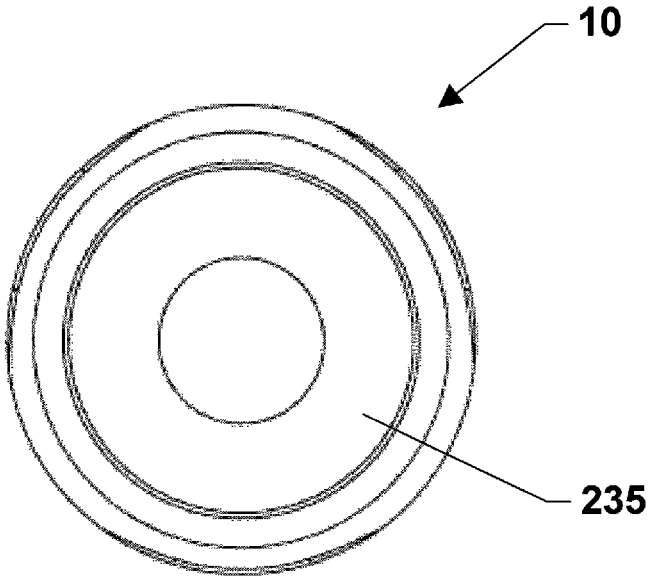
Figure 5:
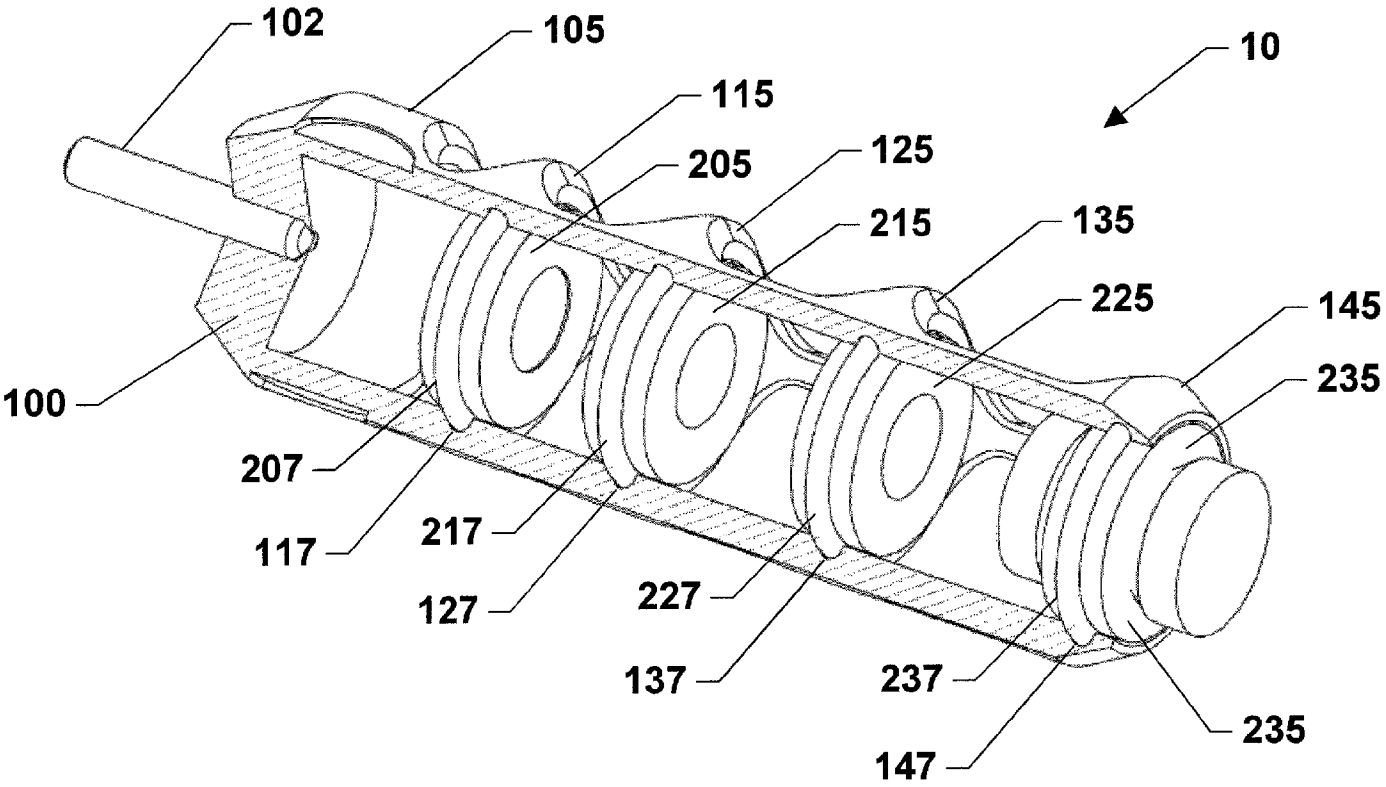
Figure 6:
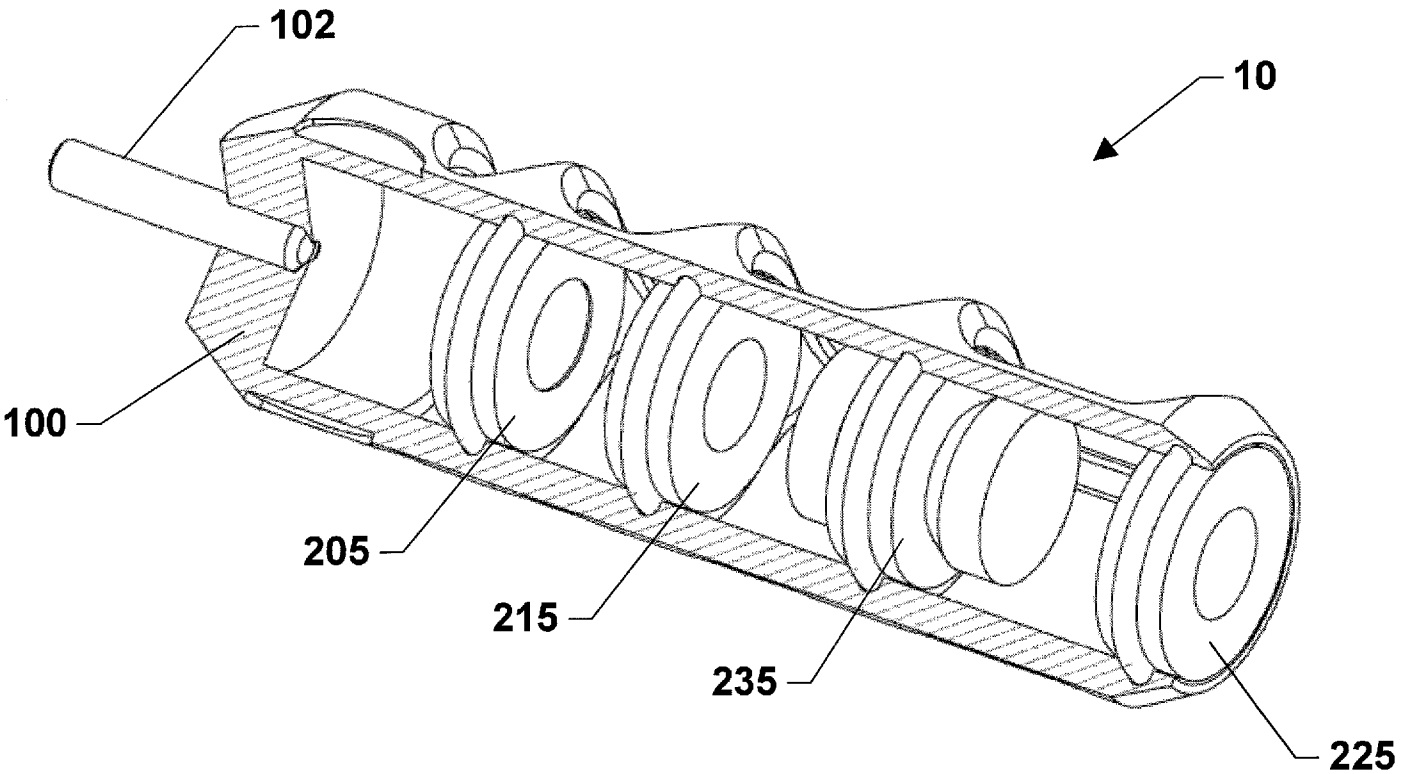
Figure 7C:
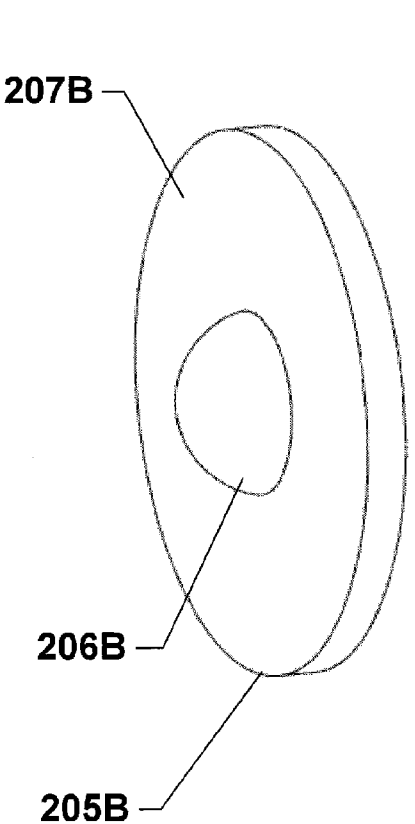
Figure 7B:
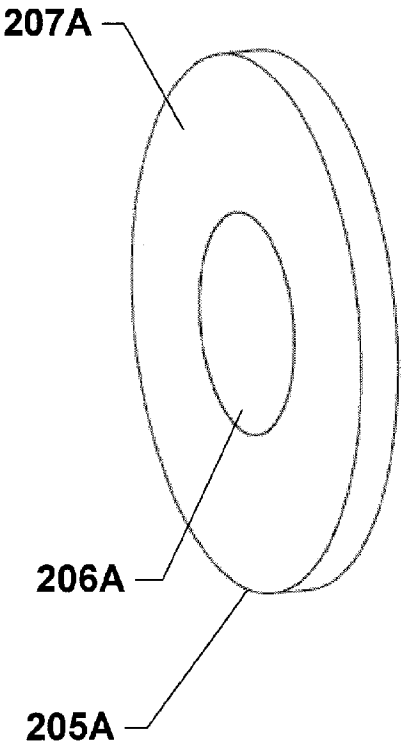
Figure 7A:
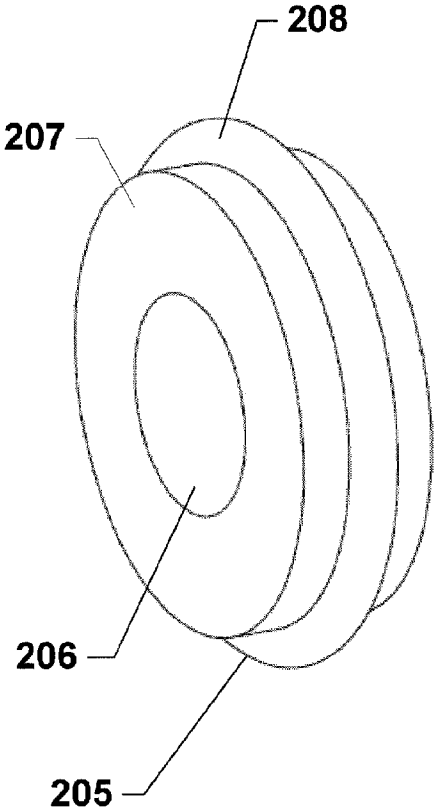
Figure 8:
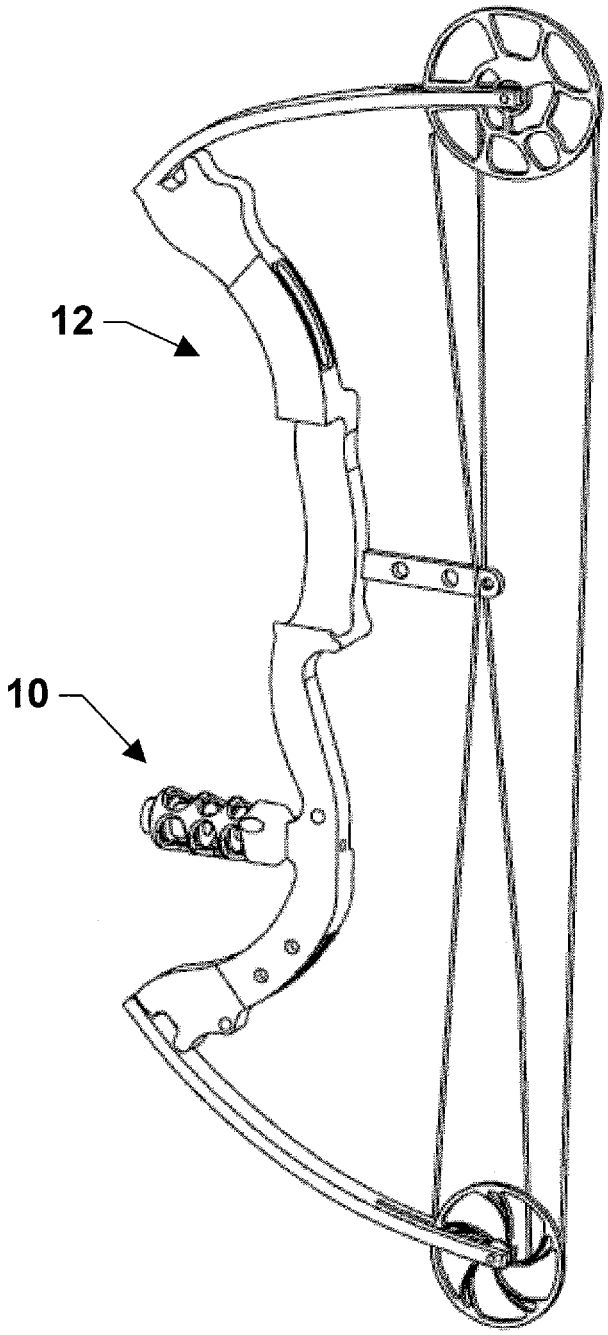
Figure 9:
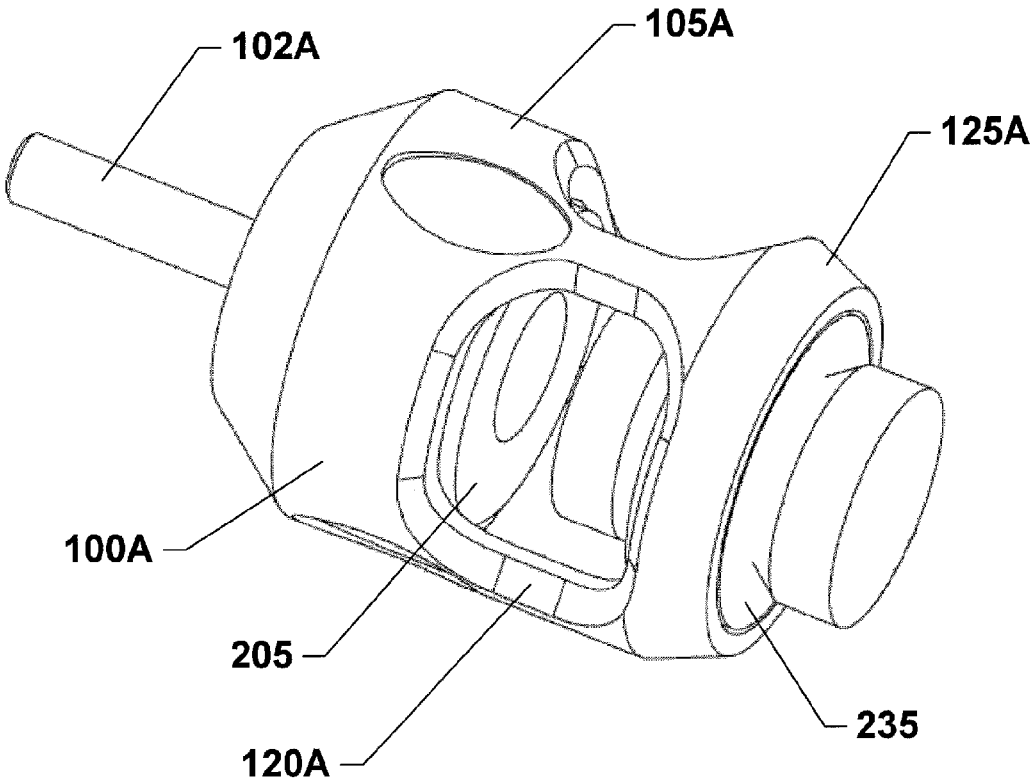
Figure 10:
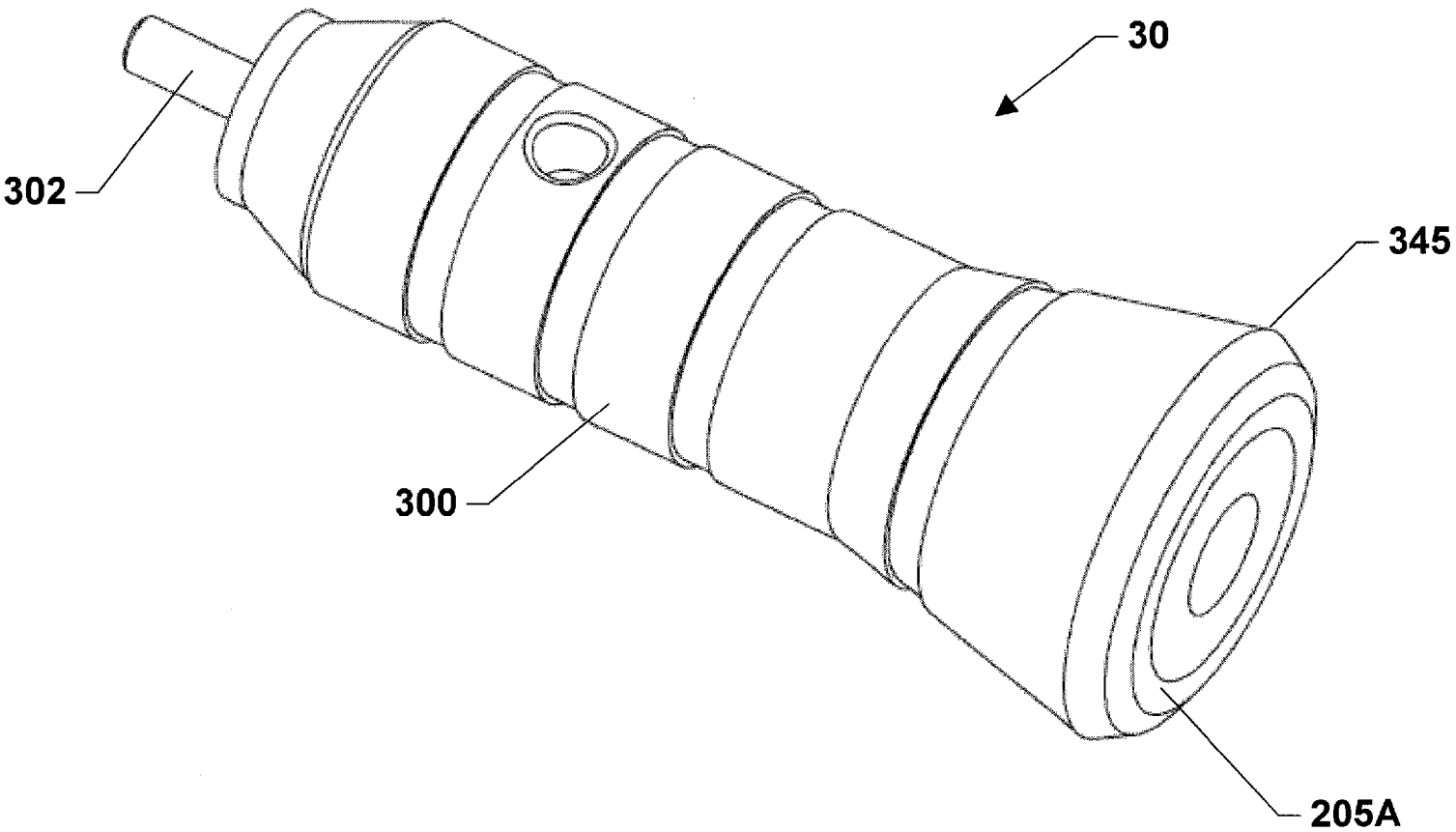
Figure 11:
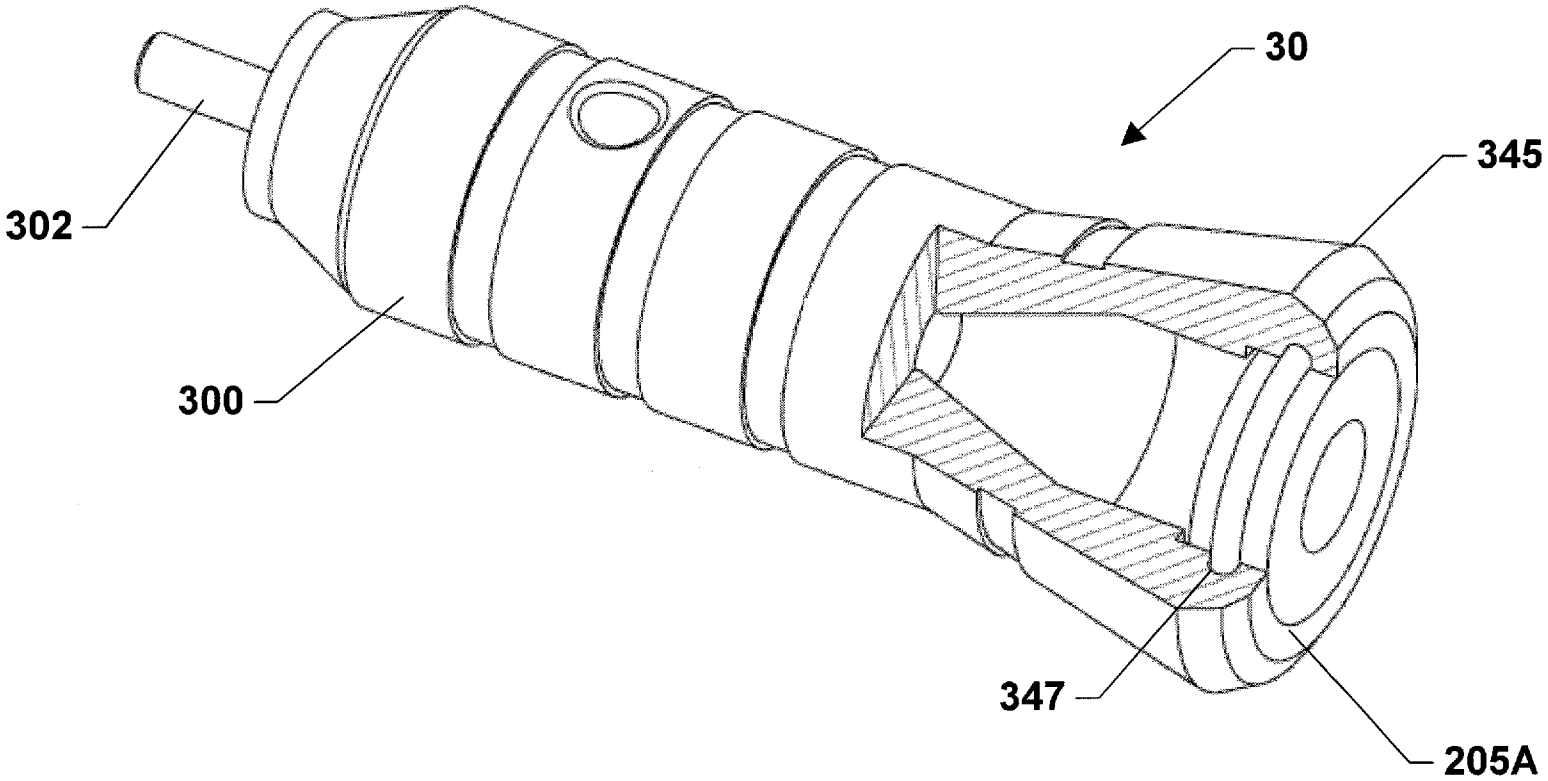
Figure 12:
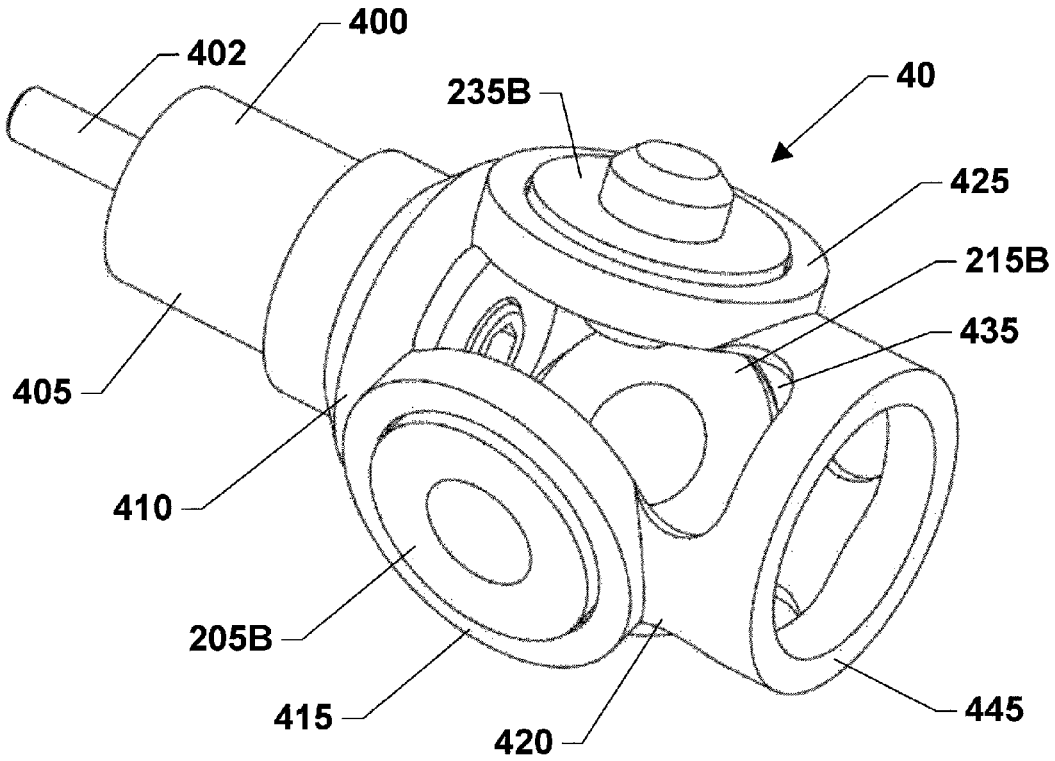
Figure 13:
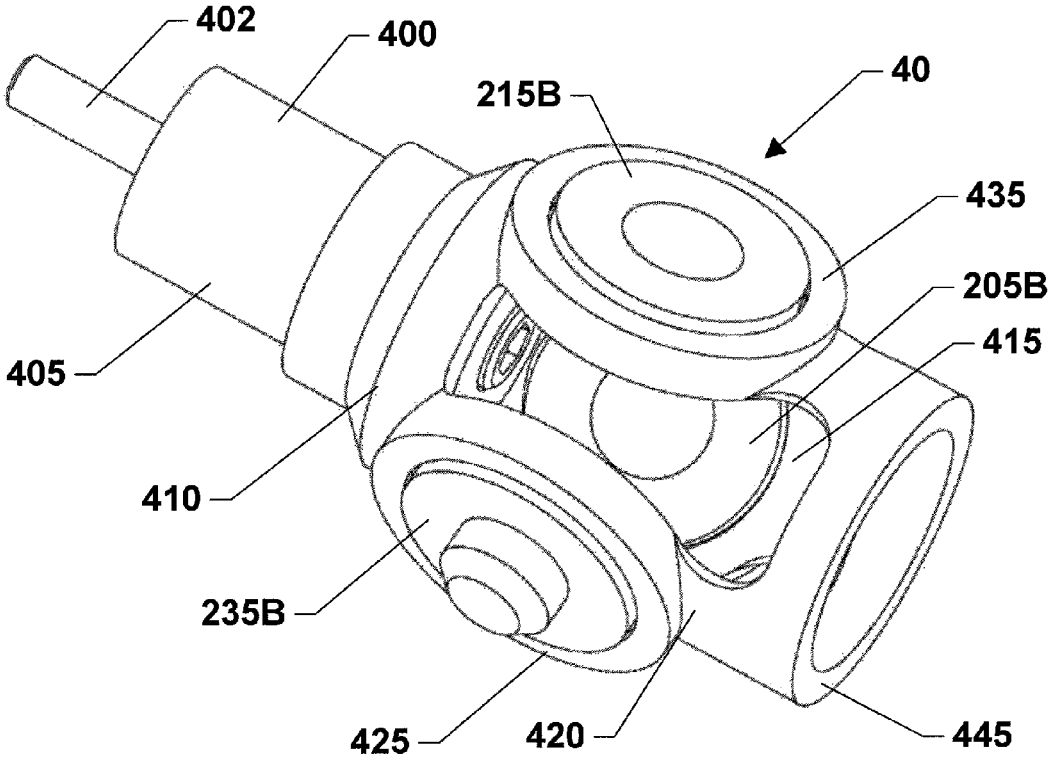
Figure 14:
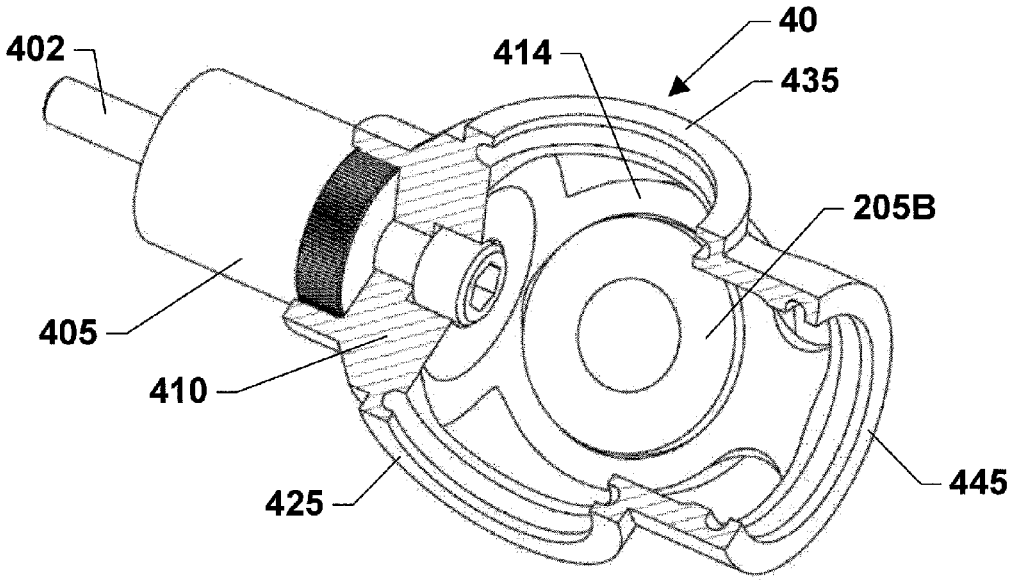
Figure 15:
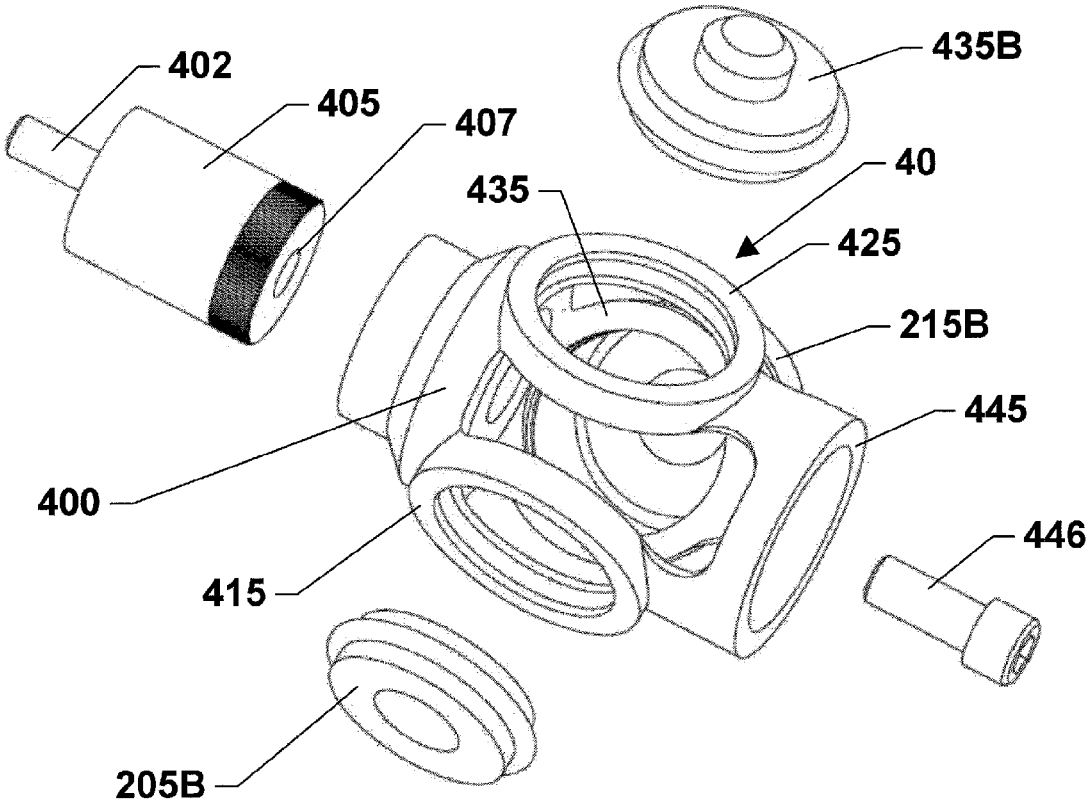
Figure 16:
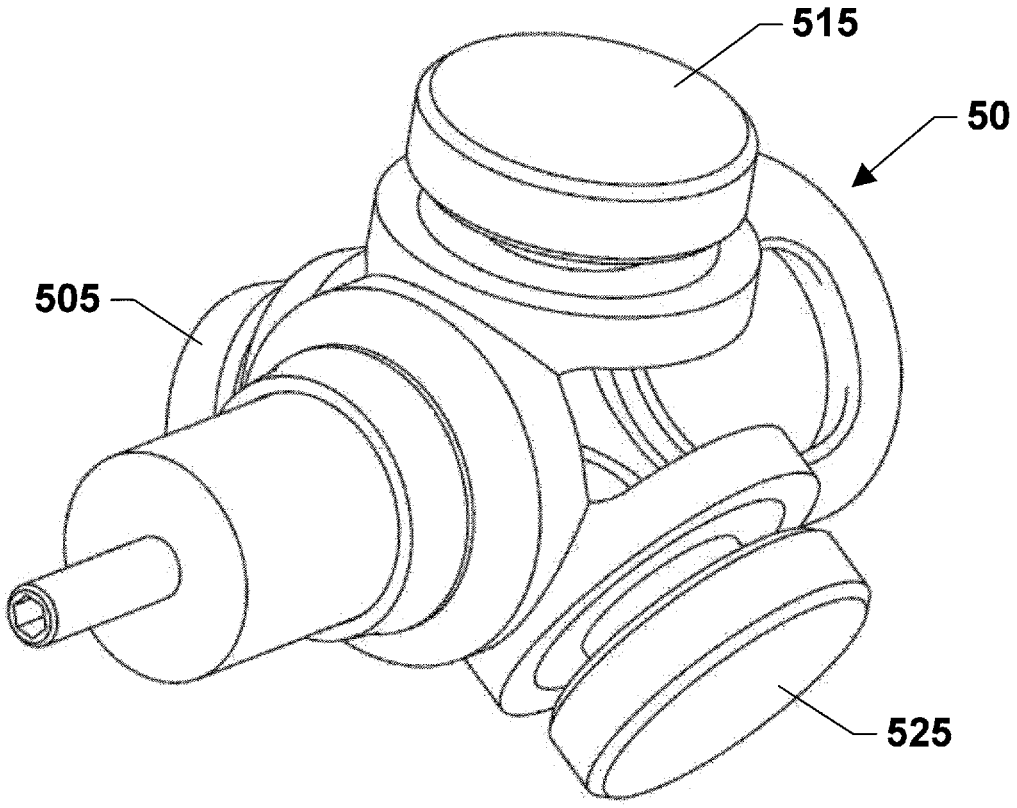
Figure 17:
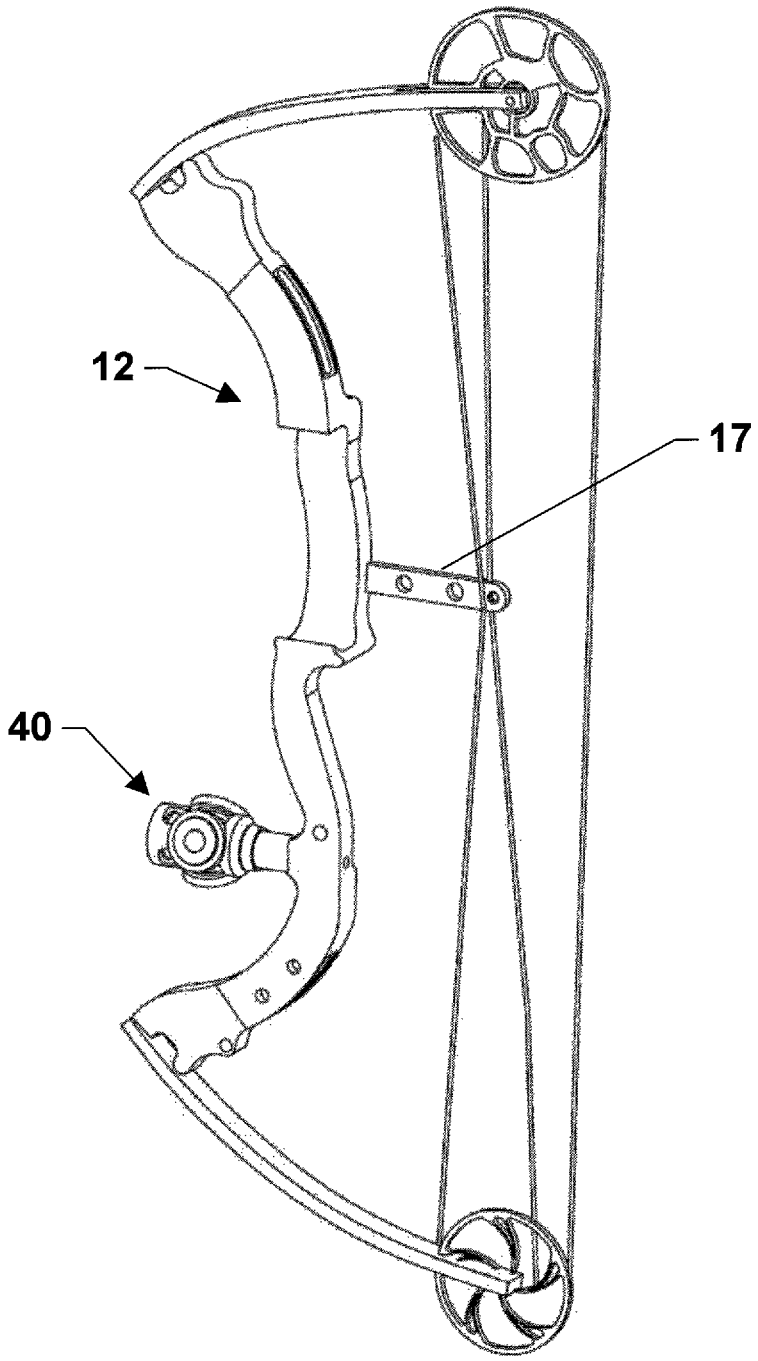
Figure 18:
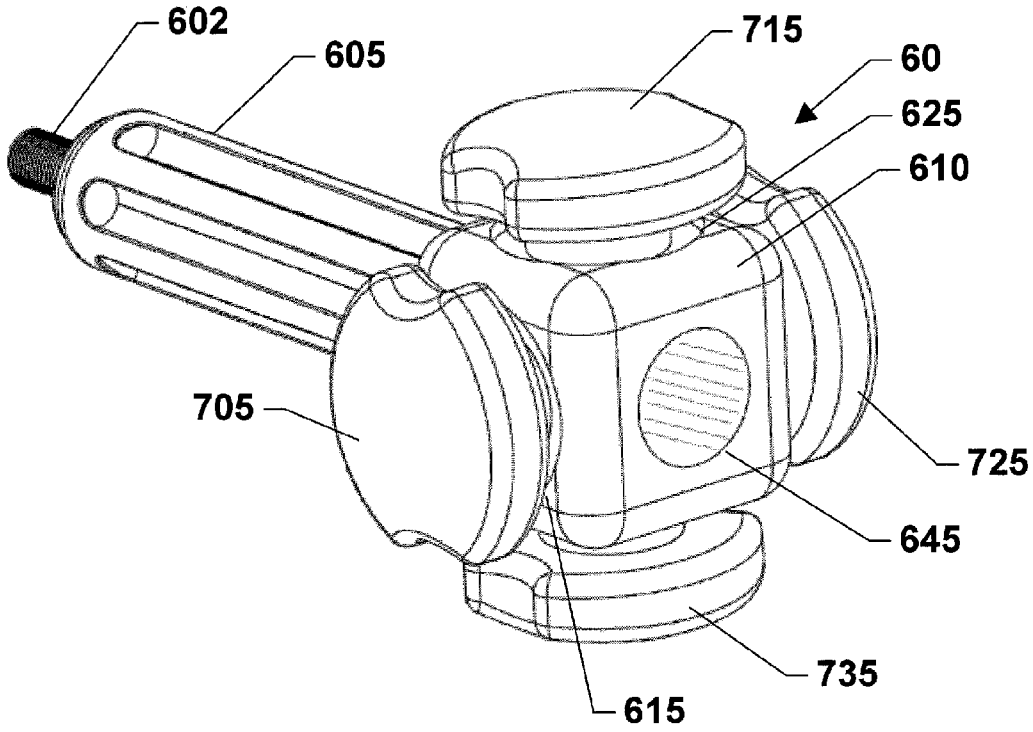
Figure 19:
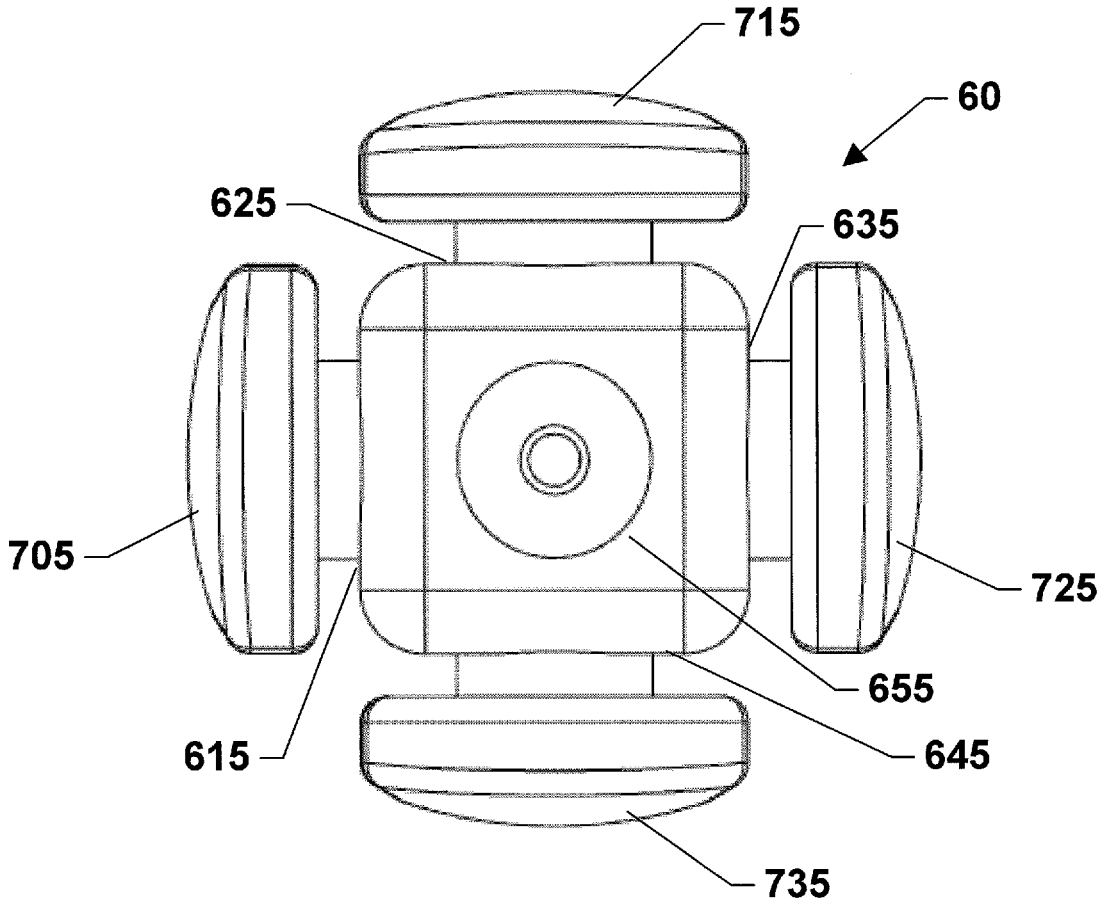
Figure 20:
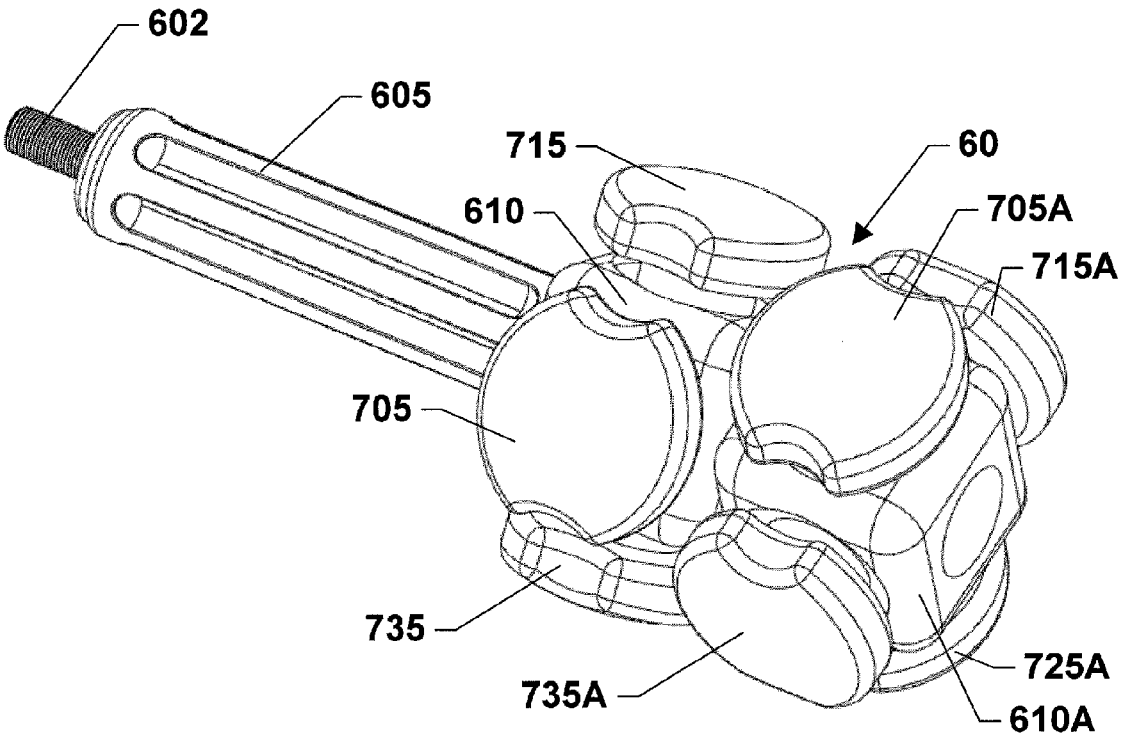
Figure 21:
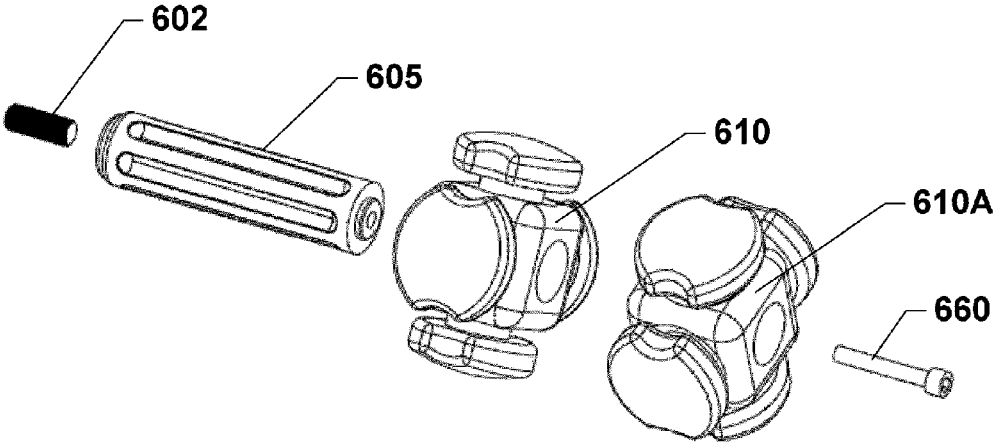
Figure 22:
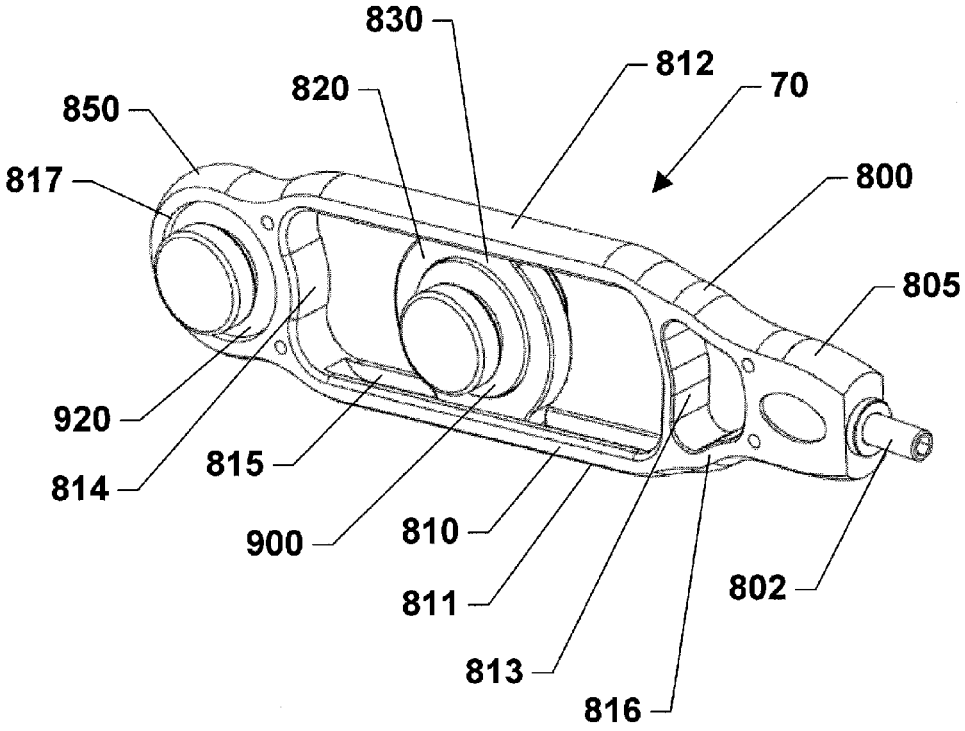
Figure 23:
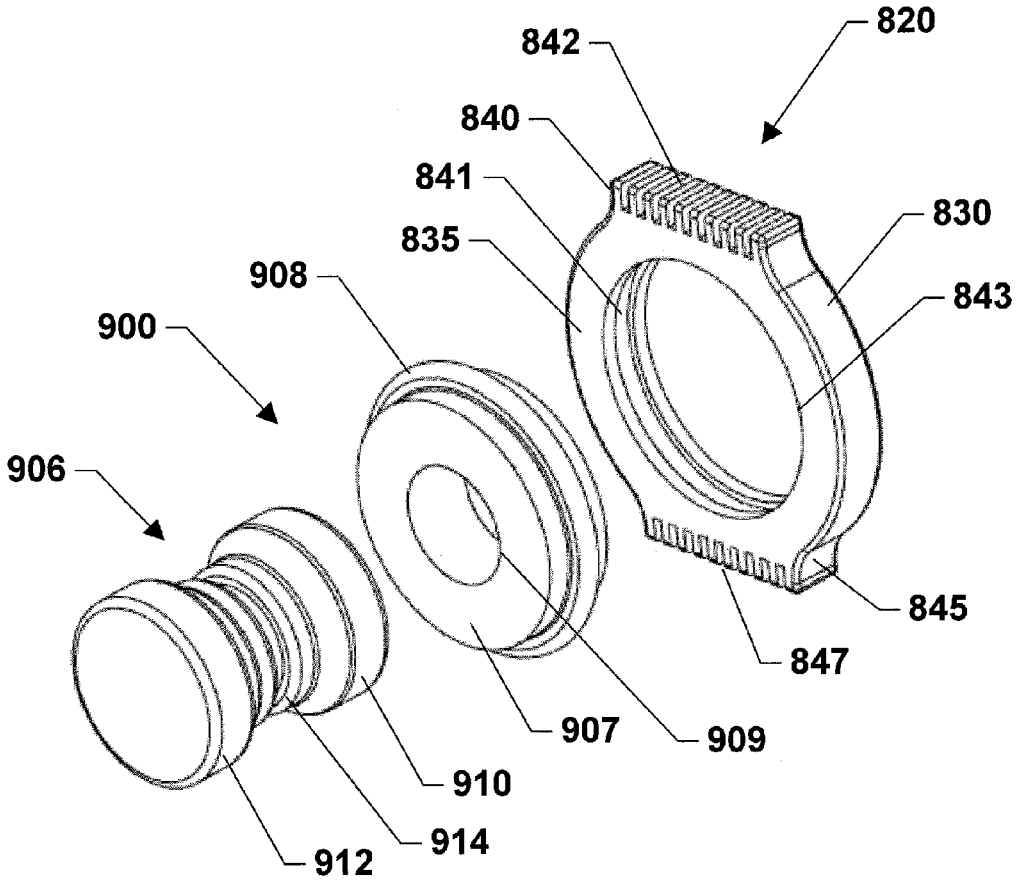
Figure 24:
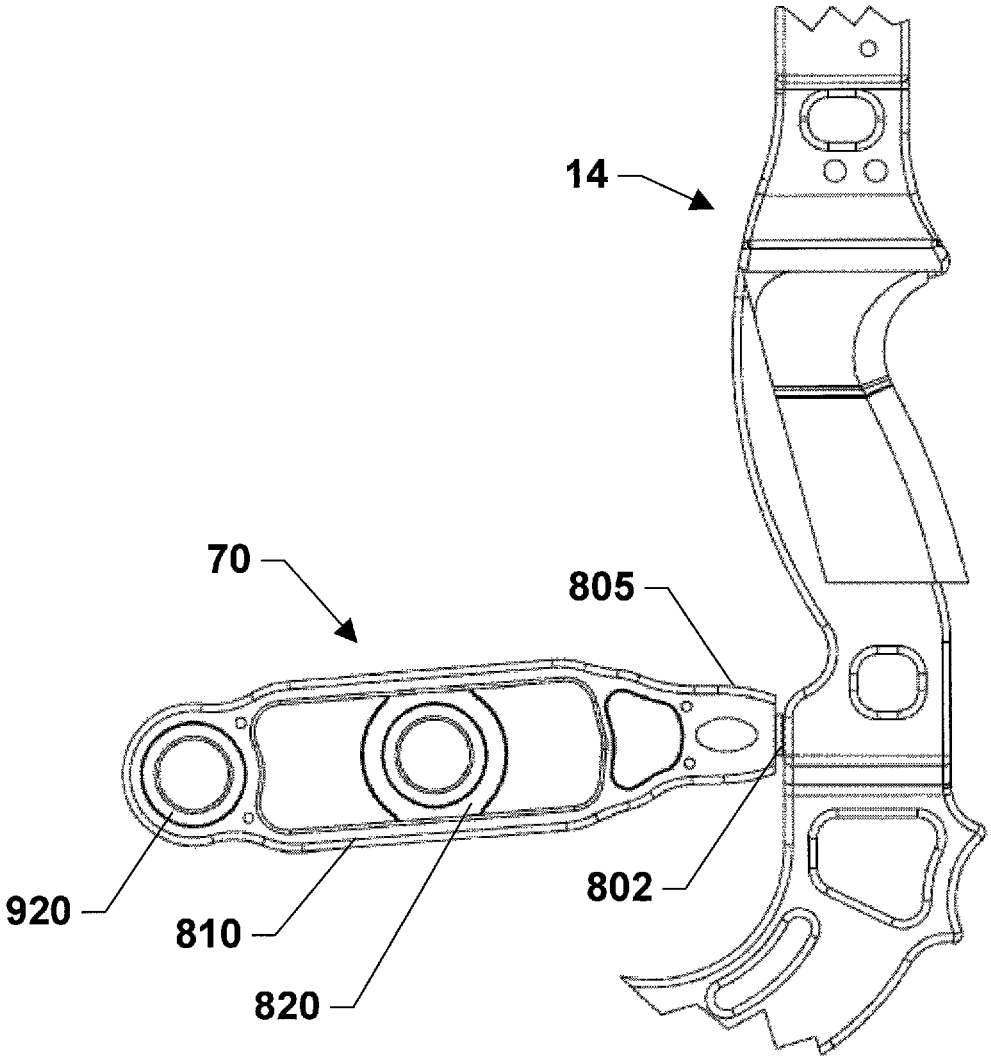
Figure 25:
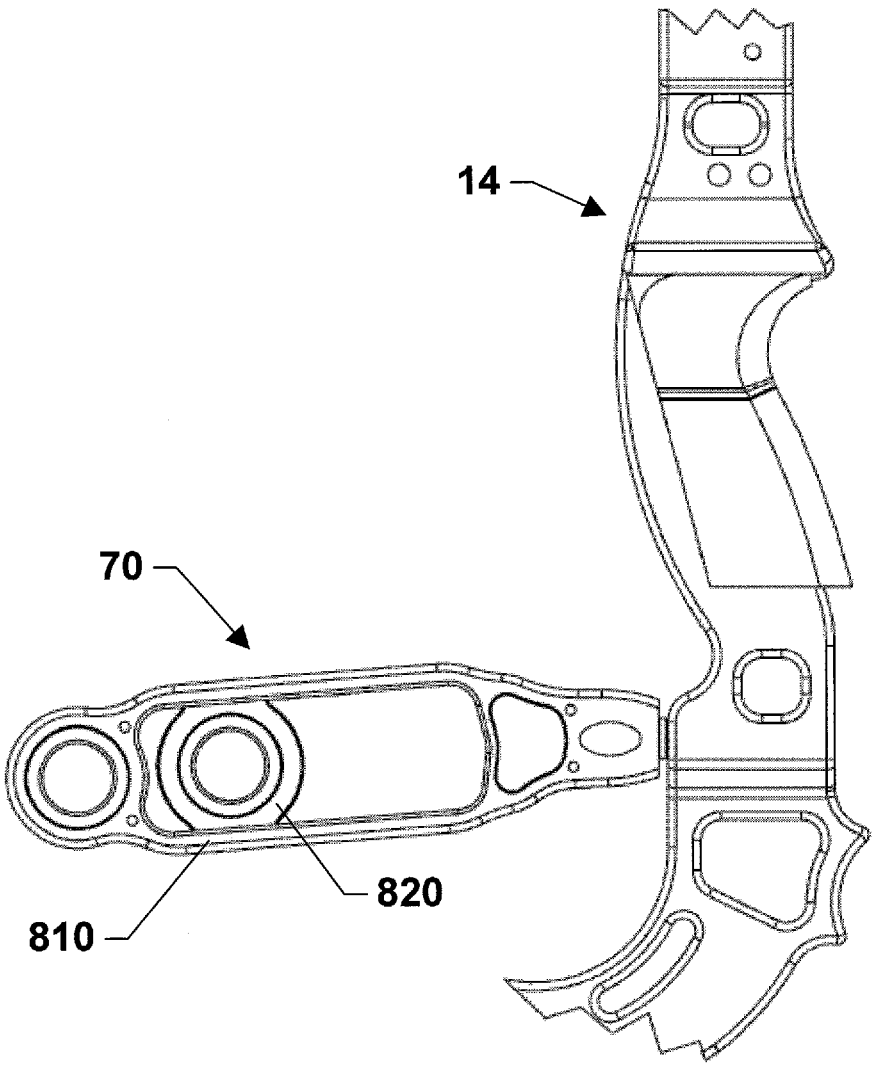
Figure 26:
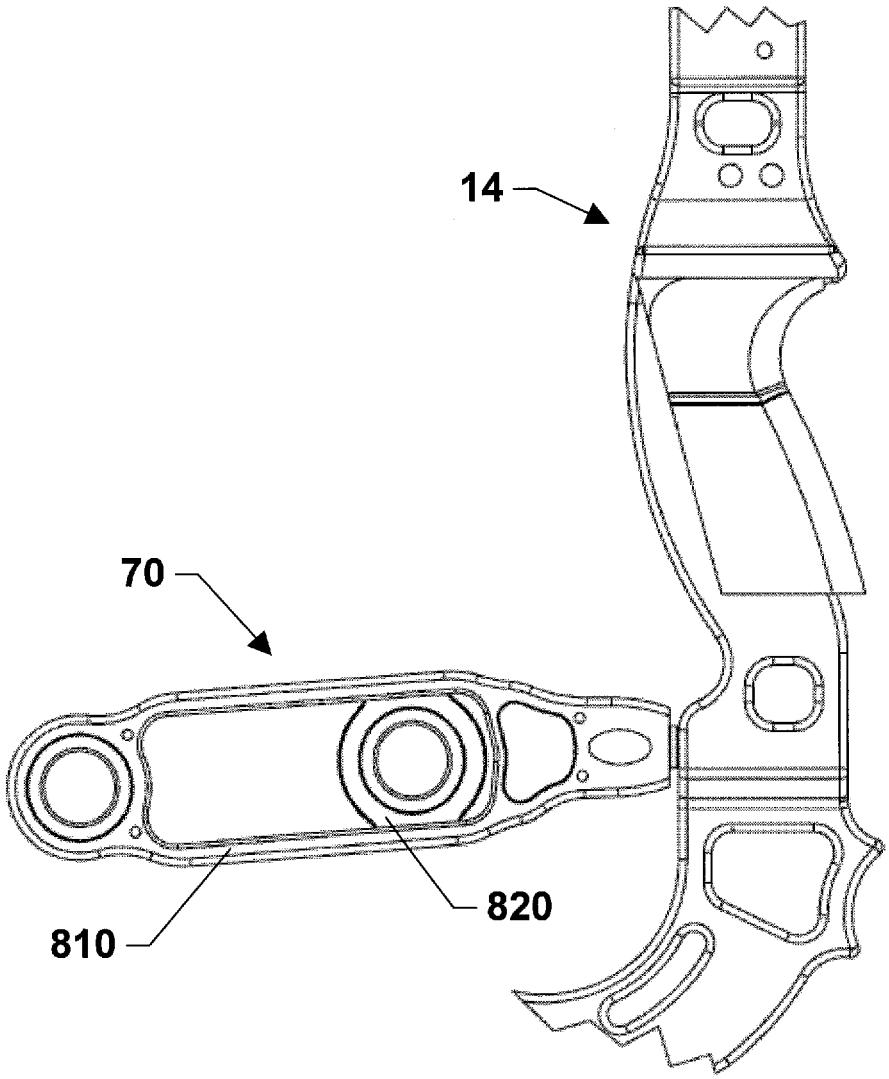

Having thus described various embodiments in general terms, reference will now be made to the accompanying drawings, which are not necessarily drawn to scale, and wherein:

FIG. 1 is a first perspective view of a bow stabilizing and shock dampening assembly according to a particular embodiment;

FIG. 2 is a second perspective view of the bow stabilizing and shock dampening assembly of FIG. 1;

FIG. 3 is a top view of the bow stabilizing and shock dampening assembly of FIG. 1;

FIG. 4 is an end view of the bow stabilizing and shock dampening assembly of FIG. 1;

FIGS. 5-6 are perspective cross sectional views of the bow stabilizing and shock dampening assembly of FIG. 1;

FIGS. 7A-7C are perspective views of substantially planar dampeners according to various embodiments;

FIG. 8 is a side view of the bow stabilizing and shock dampening assembly of FIG. 1 installed on a bow;

FIG. 9 is a perspective view of a bow stabilizing and shock dampening assembly according to another embodiment;

FIG. 10 is a perspective view of a bow stabilizing and shock dampening assembly according to a further embodiment;

FIG. 11 is a cross-sectional perspective view of the bow stabilizing and shock dampening assembly of FIG. 10;

FIG. 12 is a perspective view of a bow stabilizing and shock dampening assembly according to a particular embodiment;

FIG. 13 is a perspective view of the bow stabilizing and shock dampening assembly of FIG. 12;

FIG. 14 is a perspective cross-sectional view of the bow stabilizing and shock dampening assembly of FIG. 12;

FIG. 15 is an exploded perspective view of the bow stabilizing and shock dampening assembly of FIG. 12;

FIG. 16 is a perspective view of a bow stabilizing and shock dampening assembly according to a particular embodiment;

FIG. 17 is a side view of the bow stabilizing and shock dampening assembly of FIG. 12 installed on a bow;

FIG. 18 is a perspective view of a bow stabilizing and shock dampening assembly according to a further embodiment;

FIG. 19 is an end view of the bow stabilizing and shock dampening assembly of FIG. 18;

FIG. 20 is a perspective view of a bow stabilizing and shock dampening assembly according to a further embodiment;

FIG. 21 is an exploded view of the bow stabilizing and shock dampening assembly of FIG. 20;

FIG. 22 is a perspective view of a bow stabilizing and shock dampening assembly according to a further embodiment;

FIG. 23 is an exploded view of the sliding dampener assembly of the bow stabilizing and shock dampening assembly shown in FIG. 22; and FIGS. 24-26 are side views of the bow stabilizing and shock dampening assembly of FIG. 22 installed on a bow.

DETAILED DESCRIPTION

Various embodiments of the present invention will now be described more fully hereinafter with reference to the accompanying drawings, in which various embodiments are shown. The invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

A bow stabilizing and shock dampening assembly 10 according to a particular embodiment is shown in FIG. 1. As may be understood from this figure, the bow stabilizing and shock dampening assembly 10 comprises an elongated housing 100, and an attachment mechanism 102 that extends from a proximal end of the housing 100. The attachment mechanism 102 is adapted for attaching (e.g., selectively attaching) the bow stabilizing and shock dampening assembly 10 to a bow 12 as shown, for example, in FIG. 8. In particular embodiments, the attachment mechanism 102 is a threaded rod. However, in other embodiments, the attachment mechanism 102 may be any other suitable mechanism for attaching the bow stabilizing and shock dampening assembly 10 to the bow 12.

As may be understood from FIG. 1, the elongated housing 100 is a substantially cylindrical structure that comprises: (1) a base portion 105; (2) a first dampener support 115 that is spaced a first distance apart from the base portion 105; (3) a second dampener support 125 that is spaced a second distance apart from the base portion 105; (4) a third dampener support 135 that is spaced a third distance apart from the base portion 105; and (5) a fourth dampener support 145 that is spaced a fourth distance apart from the base portion 105.

In various embodiments, the base portion 105 and each of the first, second, third, and fourth dampener supports 115, 125, 135, 145 are hollow rings, the centers of which are substantially co-linear. For example, in the embodiment shown in FIG. 1, the centers of the first, second, third, and fourth dampener supports 115, 125, 135, 145 are all disposed on a central axis of both the bow stabilizing and shock dampening assembly 10 and the elongated housing 100. In particular embodiments, such as the embodiment of FIG. 1: (1) the distance between the third dampener support 135 and the fourth dampener support 145 is greater than (e.g., at least 20% greater than) the distance between the second dampener support 125 and the third dampener support 135; (2) the distance between the second dampener support 125 and the third dampener support 135 is greater than (e.g., at least 20% greater than) the distance between the first dampener support 115 and the second dampener support 125; and (3) the distance between the first dampener support 115 and the second dampener support 125 is greater than (e.g., at least 20% greater than) the distance between the base 105 of the elongated housing 100 and the first dampener support 115. In other embodiments, however, the dampener supports 115, 125, 135, 145 may be substantially evenly spaced apart and/or may be spaced apart in any other suitable arrangement.

In particular embodiments: (1) the base 105 of the elongated housing 100 is connected to the first dampener support 115 by a first connection portion 110: (2) the first dampener support 115 is connected to the second dampener support 125 by a second connection portion 120; (3) the second dampener support 125 is connected to the third dampener support 135 by a third connection portion 130; and (4) the third dampener support 135 is connected to the fourth dampener support 145 by a fourth connection portion 140.

As may be understood from FIGS. 1-6, in particular embodiments, the first, second, third, and fourth connection portions 110, 120, 130, 140 each comprise a plurality of (e.g., three) elongated connection members that are substantially parallel to the central axis of the elongated housing 100, and to each other. In the embodiment shown in FIG. 1, the three elongated connection members are spaced evenly apart about the outer circumference of the housing 10. In this embodiment, the elongated housing 10 defines an opening between each adjacent pair of connection members. As discussed in greater detail below, each of these openings is dimensioned to allow a user to pass a dampener 205, 215, 225, 235 from outside the housing 100, through the opening, and into the housing's interior 100.

As may be understood from FIG. 5, in particular embodiments, each of the first, second, third, and fourth dampener supports 115, 125, 135, and 145 is substantially in the form a hollow ring and defines a groove 117, 127, 137, 147 adjacent its interior surface. As discussed further below, each of these grooves 117, 127, 137, 147 is adapted to receive a portion of a respective dampener 205, 215, 225, 235, which serves to hold the dampener 205, 215, 225, 235 in place relative to the elongated housing 100.

In particular embodiments, the elongated housing 100 defines a substantially circular opening in the housing's distal end. As shown in FIGS. 5 and 6, this allows dampeners of different lengths to be supported by the fourth dampener support 145.

In various embodiments, the housing 100 is an elongated piece of metal that is generally in the form of a hollow cylinder. The hollow cylinder defines a plurality of cutouts in its sides and distal end. In other embodiments, the housing 100 may be made of one or more pieces of any other suitable material or combination of materials. For example, in particular embodiments, the respective dampener supports 115, 125, 135, 145 may be spaced apart and connected by lengths of a flexible material, such as rubber.

FIGS. 7A-7C depict dampeners 205, 205A, 205B according to three different embodiments. The dampener 205 of FIG. 7A comprises: (1) a rigid, substantially cylindrical central portion 206 (which may be made, for example, of metal or plastic); (2) a hollow cylindrical flexible outer portion 207 (which may be made of any suitable flexible material, such as rubber); and (3) a thin, ring-shaped outer lip 208 that extends about the circumference of the outer portion 207. In particular embodiments, the thickness of the lip 208 is about the same as the thickness of the respective grooves 117, 127, 137, 147 of the various dampener supports 115, 125, 135, 145. In a particular embodiment, the respective centers of the central portion 206, outer portion 207, and outer lip 208 are all substantially collinear and the dampener 205 is substantially symmetrical about its central axis.

The dampener 205A of FIG. 7B comprises a rigid, substantially cylindrical central portion 206A (which may be made, for example, of metal or plastic), and a hollow cylindrical flexible outer portion 207A (which may be made of any suitable flexible material, such as rubber). In particular embodiments, the thickness of the flexible outer portion 207A is about the same as the thickness of the respective grooves 117, 127, 137, 147 of the various dampener supports 115, 125, 135, 145.

The dampener 205B of FIG. 7C comprises a rigid, substantially spherical central portion 206B (which may be made, for example, of metal or plastic), and a hollow cylindrical flexible outer portion 207B (which may be made of any suitable flexible material, such as rubber). In particular embodiments, the thickness of the flexible outer portion 207B is about the same as the thickness of the respective grooves 117, 127, 137, 147 of the various dampener supports 115, 125, 135, 145.

Exemplary Use of Bow Stabilizer Assemblies

To use a bow stabilizing and shock dampening assembly 10 according to various embodiments, a user first positions one or more dampeners 205, 215, 225, 235 in place within the bow stabilizing and shock dampening assembly's elongated housing 100. For example, when using the bow stabilizing and shock dampening assembly 10 shown in FIGS. 1-5, a user: (1) positions the first dampener 205 in the bow stabilizing and shock dampening assembly's first dampener support 115; (2) positions the second dampener 215 in the bow stabilizing and shock dampening assembly's second dampener support 125; (3) positions the third dampener 225 in the bow stabilizing and shock dampening assembly's third dampener support 135; and (4) positions the fourth dampener 235 in the bow stabilizing and shock dampening assembly's fourth dampener support 145.

In this example, the first, second, and third dampeners 205, 215, 225 all have a structure that is similar to the dampener 205 shown in FIG. 7A. The fourth dampener 235 has a structure that is generally similar to the first, second, and third dampeners 205, 215, 225, except that the fourth dampener 235 has a center portion that is longer and heavier than the center portion of the first, second and third dampeners 205, 215, 225. This causes the fourth dampener 235 to be heavier than the first, second and third dampeners 205, 215, 225.

In the embodiment of FIGS. 1-5, a user may insert any of the various dampeners 205, 215, 225, 235 in place within the elongated housing 100 by: (1) squeezing the dampener 205, 215, 225, 235, which compresses the dampener's flexible outer portion and temporarily reduces the dampener's width; (2) inserting the dampener 205, 215, 225, 235 into the housing's interior through any suitable opening in the housing 100; (3) orienting the dampener 205, 215, 225, 235 so that it is positioned within a plane that is generally parallel to the sides of the housing 100; (3) while the dampener 205, 215, 225, 235 is in this orientation, moving the dampener 205, 215, 225, 235 toward the particular dampener support 115, 125, 135, 145 that will ultimately hold the dampener in place. The user then positions the dampener's circumferential outer lip 207, 217, 227, 237 within the groove 117, 127, 137, 147 defined by the particular dampener support 115, 125, 135, 145 until the outer lip 207, 217, 227, 237 snaps into place within the groove 117, 127, 137, 147 (and, in various embodiments, substantially matingly engages the interior portion of the dampener support 115, 125, 135, 145 that defines the groove 117, 127, 137, 147). In this configuration, the engagement between the dampener's outer lip 207, 217, 227, 237 and the dampener support 115, 125, 135, 145: (1) provides a flexible interface between the dampener 205, 215, 225, 235 and the dampener support 115, 125, 135, 145; and (2) maintains the dampener 205, 215, 225, 235 in a substantially fixed position and orientation while the dampener 205, 215, 225, 235 is installed on a bow, and while the bow is used to shoot an arrow.

To remove a dampener 205, 215, 225, 235 from the housing 100, a user may simply push the dampener 205, 215, 225, 235 out of engagement with the dampener support 115, 125, 135, 145, and then use their fingers to pull the dampener 205, 215, 225, 235 through a suitable opening in the housing 100.

As may be understood from the example above, in various embodiments, the bow stabilizing and shock dampening assembly 10 is adapted to allow users to, without tools, install dampeners 205, 215, 225, 235 into, and remove dampeners 205, 215, 225, 235 from, the bow stabilizing and shock dampening assembly's housing 100. This may, for example, allow users to quickly change the configuration of the bow stabilizing and shock dampening assembly 10.

For example, turning to FIG. 5, if a user wishes to move weight away from the end of the bow stabilizing and shock dampening assembly 10 and toward the middle of the assembly 10, a user may use the techniques described above to: (1) remove the third and fourth dampeners 225, 235 from the bow stabilizing and shock dampening assembly 10; (2) insert the fourth dampener 235 in the third dampener support 135; and (3) insert the third dampener 225 in the fourth dampener support 145. Similar techniques may be used to allow users to rearrange or remove the various dampeners (e.g., without tools) as desired. As an aside, it should be understood in light of the above that the bow stabilizing and shock dampening assembly 10 may be adapted for use without dampeners 205, 215, 225, 235 disposed in each of the bow stabilizing and shock dampening assembly's various dampener supports 115, 125, 135, 145.

Once the dampeners 205, 215, 225, 235 are in their desired positions within the bow stabilizer's housing 100, the user may attach the bow stabilizing and shock dampening assembly 10 to a bow (e.g., by screwing a threaded distal end of the bow stabilizing and shock dampening assembly's attachment mechanism 102 into a threaded recess in a front surface of the bow.) FIG. 8 shows a particular example in which the bow stabilizing and shock dampening assembly 10 is installed adjacent a front surface of a bow 12. The user then uses the bow 12 in the traditional manner to shoot arrows.

As shown in FIG. 8, in particular embodiments, when the bow stabilizing and shock dampening assembly 10 is installed adjacent the bow 10: (1) the bow stabilizing and shock dampening assembly's various dampeners 205, 215, 225, 235 are substantially parallel to each other; (2) the respective centers of the bow stabilizing and shock dampening assembly's various dampeners 205, 215, 225, 235 are at least substantially co-linear (e.g., they are co-linear); (3) each of the dampeners 205, 215, 225, 235 is disposed within a plane that is substantially perpendicular to the plane of the bow 12; and (4) the dampeners 205, 215, 225, 235 engage the housing's dampener supports 115, 125, 135, 145 about at least a portion of the circumference (e.g., part, or the entire circumference) of the dampeners 205, 215, 225, 235.

Exemplary Design Variations

The bow stabilizer assemblies described above may be provided in a variety of different lengths and configurations, and with a variety of numbers of dampeners and/or dampener supports. For example, the embodiment shown in FIG. 9 includes two dampener supports 105A, 125A that collectively support two different dampeners 205, 235.

As another example, the alternative embodiment of FIG. 10 includes a hollow flexible (e.g., rubber) housing 300 that defines a series of circumferential grooves that extend around the side portions of the housing as shown in FIGS. 10 and 11. The housing 300 defines a single dampener support 345 adjacent the distal end of the housing 300 for supporting a dampener 205A in the manner described above. In various embodiments, the distal end of the housing 300 is flared as shown in FIG. 10.

This bow stabilizing and shock dampening assembly 30 may be installed adjacent a bow (e.g., in the same general manner shown in FIG. 8) so that the bow stabilizing and shock dampening assembly's dampener is disposed within a plane that is substantially perpendicular to the plane of the bow. Also, in particular embodiments, the housing is adapted so that the dampener may be selectively removed from, or installed in, the housing 300 without tools.

Additional Embodiments

Embodiment of FIGS. 12-17

A bow stabilizing and shock dampening assembly 40 according to an additional embodiment is shown in FIGS. 12-15. As may be understood from these figures, this bow stabilizing and shock dampening assembly 40 comprises: (1) an attachment mechanism 402; (2) a first dampener support 415; (3) a second dampener support 425; (3) a third dampener support 435; and (4) a support structure that is adapted to support the first, second, and third dampener supports. In the embodiment shown in FIG. 12, the support structure includes a first connection portion 410 and a second connection portion 420. However, in other embodiments, the support structure may be in any other suitable form. The bow stabilizing and shock dampening assembly's attachment mechanism 402 is adapted for attaching (e.g., selectively attaching) the bow stabilizing and shock dampening assembly 40 to a bow (e.g. in the manner shown in FIG. 17) and may comprise, for example, any of the attachment mechanism embodiments described above.

As may be understood from FIGS. 12-15, the first, second, and third dampener supports 415, 425, 435 may be, for example, structurally similar to any of the dampener supports discussed above, and may be adapted to support any of a variety of suitable dampeners, such as dampeners 205B, 215B, and 235B, which are shown in FIG. 12. In view of the discussion above, it should be understood that, due to the various structural properties of the dampeners 205B, 215B, and 235B and the dampener supports 415, 425, 435, in various embodiments, a user may selectively install the dampeners 205B, 215B, and 235B into the dampener supports 415, 425, 435 without tools. Similarly, in various embodiments, a user may selectively remove the dampeners 205B, 215B, and 235B from the dampener supports 415, 425, 435 without tools. In other embodiments, tools may be required to install and/or remove the dampeners 205B, 215B, and 235B.

As will be discussed in greater detail below, in various embodiments, the first dampener support 415 is adapted to maintain the first dampener 205B in a first plane, the second dampener support 425 is adapted to maintain the second dampener 235B in a second plane, and the third dampener support 435 is adapted to maintain the third dampener 215B in a third plane (e.g., in the manner described above in regard to various other embodiments).

In various embodiments, the support structure supports the first, second, and third dampener supports 415, 425, 435 and maintains the first, second, and third dampener supports 415, 425, 435 in a substantially fixed relationship to each other. As shown in FIGS. 12-15, in the embodiment shown in these figures, the support structure connects the first, second, and third dampener supports 415, 425, 435 together.

In various embodiments, the first, second, and third dampener supports 415, 425, 435 collectively maintain the first, second, and third dampeners 205B, 215B, and 235B in planes that intersect each other (e.g., the first, second, and third planes are not parallel).

As shown in FIG. 12, the first plane (in which the first dampener 205B is disposed) intersects the second plane (in which the second dampener 235B is disposed). In particular embodiments, the angle of intersection between the first plane and the second plane may be any angle between about 15° and about 90° (e.g. about 30°, about 45°, about 60°, about 90°, or any other suitable angle). Similarly, in various embodiments, the angle of intersection between the second plane and the third plane may be any angle between about 15° and about 90° (e.g. about 30°, about 45°, about 60°, about 90°, or any other suitable angle). By the same token, in certain embodiments, the angle of intersection between the third plane and the first plane may be any angle between about 15° and about 90° (e.g. about 30°, about 45°, about 60°, about 90°, or any other suitable angle).

In various embodiments, such as the embodiment shown in FIGS. 12-15, a line of intersection between the first and second planes may be substantially parallel to: (1) a line of intersection between the second and third planes; and/or (2) a line of intersection between the first and third planes. In the embodiment of FIGS. 12-15, the first, second and third planes form an equilateral triangular prism where the angle of intersection between the planes is about 60°). In alternative embodiments, the angle of intersection between the planes may be any other suitable angle between, for example, about 15° and about 90° (e.g. about 30°, about 45°, about 60°, or about 90°, or any other suitable angle).

As may be seen in FIGS. 12-15, in particular embodiments, the first, second, and third planes are substantially uniformly distributed (e.g., substantially evenly spaced apart) about a central axis of the support structure 400. For example, the dampener supports 410, 412, 414 form a perimeter about the central axis of the support structure and/or the central axis of the bow stabilizing and shock dampening assembly 40. In such an embodiment, the dampener supports 410, 412, 414 at least substantially surround (e.g., the dampener supports 410, 412, 414 may surround) the central axis of the support structure and/or the central axis of the bow stabilizing and shock dampening assembly 40.

In the embodiment shown in these FIGS. 12-15, each of the first, second, and third dampener supports 415, 425, 435 is adapted to maintain a respective dampener 205B, 215B, 235B in a plane that is at least substantially parallel to: (1) a central axis of the support structure; (2) the central axis of the bow stabilizing and shock dampening assembly 40, and/or (3) the central axis of the attachment mechanism 402. In this embodiment, the bow stabilizing and shock dampening assembly 40 is adapted so that, when the bow stabilizing and shock dampening assembly 40 is attached, via the attachment mechanism 402, to a bow as shown in FIG. 17: (1) the first and second planes intersect to form a line that is substantially parallel to the bow's cable rod 17; (2) the second and third planes intersect to form a line that is substantially parallel to the bow's cable rod 17; and (3) the third and first planes intersect to form a line that is substantially parallel to the bow's cable rod 17.

In particular embodiments, the first, second, and third planes may form an orthogonal system. Also, in some embodiments, the angles of intersection may also be different within the system (e.g., the angle of intersection between the first and second plane may be different than the angle of intersection between the first and third plane).

It should also be understood that different types of dampeners may be used in different embodiments. For example, the dampeners 505, 515, and 525 shown in FIG. 16 are somewhat larger than the dampeners 205B, 215B, and 235B shown in the embodiment of FIGS. 12-15.

In particular embodiments, the bow stabilizing and shock dampening assembly 40 may further comprise a fourth dampener support 445 (which is shown in FIGS. 12-15 not supporting a dampener). The fourth dampener support 445 may be disposed, for example, adjacent a distal end of the support structure 400.

Embodiment of FIGS. 18-19

FIGS. 18-19 depict an alternative embodiment of the assembly described generally above in which the assembly 60 includes four dampeners 705, 715, 725, 735 that are spaced evenly apart about the central axis of the assembly's support structure 610. In particular, this embodiment comprises: (1) an attachment mechanism 602; (2) a base portion 605; (3) a first dampener support 615; (4) a second dampener support 625; (5) a third dampener support 635; (6) a fourth dampener support 645; (7) a fifth dampener support 655; and (8) a support structure 610 that is adapted to support the first, second, third, fourth, and fifth dampener supports 615, 625, 635, 645, 655. In this embodiment, the first, second, third, and fourth dampener supports 615, 625, 635, 645 are adapted to maintain the first, second, third, and fourth dampeners 705, 715, 725, 735 in respective planes that cooperate to form a cuboid that surrounds a central axis of the bow stabilizing and dampening assembly 60.

A user may use the embodiment shown FIGS. 18 and 19 in much the same way as the other embodiments described herein.

Embodiment of FIGS. 20-21

FIGS. 20-21 depict a further embodiment that comprises the bow stabilizing and dampening assembly 60 of FIGS. 18-19 in combination with a second support structure 610A, which is disposed adjacent a distal end of the assembly's first support structure 610. In particular embodiments, this second support structure 610A is substantially identical to the first support structure 610 and the first and second support structures 610, 610A are attached to the base portion 605 by a fastener (e.g., a threaded bolt) that extends through each of the first and second support structures 610, 610A adjacent the central axes of the support structures 610, 610A.

The second support structure 610A is adapted to support additional first, second, third, fourth, and fifth dampener supports. As shown in FIGS. 20-21, the additional first, second, third, and fourth dampener supports are adapted to maintain additional first, second, third, and fourth dampeners 705A, 715A, 725A, 735A in respective planes that cooperate to form a cuboid that surrounds the central axis of the bow stabilizing and dampening assembly 60.

In additional embodiments, the first and second support structures 610, 610A are substantially identical support modules that are adapted to cooperate to form a support module assembly. In these embodiments, the bow stabilizing and dampening assembly 60 may comprise: (1) an attachment mechanism 602 that is adapted to attach the assembly to a bow; (2) a support module assembly that includes a plurality of support structures 610, 610A (e.g., two, three, four, or five support structures) that are each adapted to support one or more dampeners as described above; and (3) a base portion 605 that extends between the attachment mechanism 602 and the support module assembly. The support structures 610, 610A may be attached adjacent one another to form a substantially linear support module assembly.

In various embodiments, within the support module assembly, the support structures 610, 610A may be selectively rotated relative to one another and/or relative to the base portion 605 (e.g., by loosening the fastener 660 and rotating one or more of the support structures 610, 610A into the desired orientation). Once the support structures 610, 610A are in the desired position, the support structures 610, 610A may be fixed in place by selectively tightening the fastener 660.

In various embodiments, the support structures 610, 610A may be adapted to support any number of dampeners (e.g., one, two, three, four, or five dampeners). The support structures 610, 610A may be any shape (e.g., in the form of a cylinder, prism, cube, or any other suitable shape) and may support the dampeners in a substantially uniform arrangement or in a non-uniform arrangement.

A user may use the embodiment shown in FIGS. 20 and 21 in much the same way as the other embodiments described herein. In particular embodiments, the first and second support structures 610, 610A may be selectively rotated relative to one another (e.g., about the central axis of the bow stabilizing and dampening assembly 60). In particular embodiments, an angle between the first dampener 705 of the first support structure 610 and the first dampener 705A of the second support structure 610A may be selectively adjusted by a user. In particular embodiments, the angle between these respective first dampeners 705, 705A may be selectively adjusted by a user to any angle between 0° and 360° (e.g., 10°, 15°, 30°, or 45°).

As noted above, in various embodiments, a fastener 660 (e.g., a threaded screw or bolt) may be used to selectively prevent the first and second support structures 610, 610A from rotating relative to one another and to selectively fix the angle between the support structures' respective first dampeners 705, 705A. In particular embodiments, the base portion 605 may be adapted to store any excess length of the fastener 660 when a particular module is removed from the module assembly (e.g., when one of the plurality of modules is removed, the end portion of the fastener 660 may extend into a cavity defined by the base portion 605).

Embodiment of FIGS. 22-26

A bow stabilizing and shock dampening assembly 70 according to a further embodiment of the invention is shown in FIGS. 22-26. As may be understood from these figures, the bow stabilizing and shock dampening assembly 70 includes a substantially planar, elongated housing 800 that includes a proximal base portion 805, a distal dampener support 850, and a dampener assembly support rack 810 that extends between the base portion 805 and the distal dampener support 850. The bow stabilizing and shock dampening assembly 70 further includes an attachment mechanism 802 for attaching the bow stabilizing and shock dampening assembly 70 to a bow 14.

The bow stabilizing and shock dampening assembly 70 also includes one or more dampeners 900, 920 for stabilizing the bow 14 to which the bow stabilizing and shock dampening assembly 70 is attached, and for dampening vibrations within the bow 14 when the bow 14 is fired. For example, in the embodiment shown in FIGS. 22-26, the bow stabilizing and shock dampening assembly 70 includes: (1) a sliding dampener assembly 820 that includes a dampener 900, and that is slideably attached between opposing support structures 811, 812 within the dampener assembly support rack 810; and (2) a non-sliding dampener 920 that is maintained in a substantially fixed position by the distal dampener support 850. The components above are discussed in greater detail below.

Elongated Housing

As may be understood from FIG. 22, in a particular embodiment, the elongated housing 800 is a substantially planar structure having a substantially uniform width. The elongated housing 800 includes a base portion 805 that connects, via a forked connection structure 816, to the dampener assembly support rack 810. As may be understood from FIG. 22, the support rack 810 may include a substantially rectangular frame that comprises: (1) a first, proximal side member 813; (2) a second, distal side member 814; (3) a first elongated support structure 811 that extends between corresponding first ends of the first and second side members 813, 814; and (4) a second elongated support structure 812 that extends between corresponding second ends of the first and second side members 813, 814. As shown in FIG. 22, the first and second elongated support structures 811, 812 are offset from, at least substantially parallel to, and co-facing each other.

Each of the elongated support structures 811, 812 defines an elongated groove 815 on its interior surface that is suitable for receiving one end of the sliding dampener assembly 820 when the sliding dampener assembly 820 is slideably attached to the dampener assembly support rack 810.

The elongated housing's second, distal dampener support 850 is semicircular and extends outwardly from the first elongated support structure's second side member 814. As may be understood from FIG. 22, the second dampener support 850 and second side member 814 cooperate to define a substantially circular opening 817 that is dimensioned to receive a second dampener 920.

Sliding Dampener Assembly

As may be understood from FIG. 23, the bow stabilizing and shock dampening assembly's sliding dampener assembly 820 includes a dampener support 830 and a dampener 900. In particular embodiments, the dampener support 830 includes a substantially circular support portion 835, a first end portion 840, and a second end portion 845. The first end portion 840 includes a plurality of ridges 842 that extend outwardly relative to the support portion 835. These ridges 842 may each be, for example, substantially planar, and the ridges 842 may be positioned in an array in which the ridges 842: (1) are at least substantially parallel to each other; and (2) cooperate to form a substantially flat end surface of the first end portion 840.

Similarly, the second end portion 845 includes a plurality of ridges 847 that extend outwardly relative to the support portion 835. These ridges 847 may each be, for example, substantially planar, and the ridges 847 may be positioned in an array in which the ridges 847: (1) are at least substantially parallel to each other; and (2) cooperate to form a substantially flat end surface of the second end portion 845.

In various embodiments, the dampener 900 includes a substantially O-shaped outer portion 907, which defines a substantially circular central opening 909 that is centered about the outer portion's central axis. The outer portion 907 further includes a lip 908 that extends circumferentially around the outer perimeter of the outer portion 907.

The dampener 900 further includes a center portion 906 that includes: (1) a substantially circular first end 910; (2) a substantially circular second end 912; (3) a connector 914 that extends between, and connects, the center portion's first and second ends 910, 912. In particular embodiments, the center portion 914 is positioned so that: (1) its first end 910 is adjacent a first lateral surface of the dampener's outer portion 907; (2) its second end 912 is adjacent a second lateral surface of the dampener's outer portion 907; (3) its connector 914 extends through the outer portion's central opening 909. The dampener 900 may be a Matthews Harmonic Stabilizer, or other suitable dampener.

In particular embodiments, the sliding dampener assembly's dampener support 830 defines an interior groove 841 that extends circumferentially around the interior surface of the dampener support 830 as shown in FIG. 23. In such an embodiment, the circumference of the outer portion's central opening 843 is about the same as the circumference of the dampener's outer portion 907. Also, the lip 908 of the dampener 900 is dimensioned to mate with the dampener support's interior groove 841 to frictionally maintain the dampener 900 in place within the dampener support's central opening 843 so that: (1) the dampener's outer portion 907 is substantially co-planar with the dampener support 830; and (2) the dampener 900 is at least substantially laterally centered relative to the plane in which the dampener support 830 is positioned.

Second Dampener

In various embodiments, the second dampener 920 has a structure that is similar to the structure of the dampener 900 that is part of the sliding dampener assembly 820. In particular embodiments, the second dampener support 850 defines an interior groove (not shown) that, like the interior groove of the sliding dampener assembly 820, extends circumferentially around the interior surface of the second dampener support 850. In such an embodiment, the circumference of the second dampener support's central opening 817 is about the same as the circumference of the second dampener's outer portion. Also, the lip of the second dampener 920 is dimensioned to mate with the second dampener support's interior groove to frictionally maintain the second dampener 920 in place within the second dampener support's central opening so that: (1) the second dampener's outer portion is substantially co-planar with the second dampener support 850; and (2) the second dampener 920 is at least substantially laterally centered relative to the plane in which the second dampener support 850 is positioned.

Use of the Shock Dampening Assembly of FIGS. 22-26

To use the bow stabilizing and shock dampening assembly 70 of FIGS. 22-26, a user first attaches the bow stabilizing and shock dampening assembly 70 to a bow 14 or other weapon. The user may do this, for example, by inserting the assembly's attachment mechanism 802 into a corresponding opening on the bow 14 (e.g., on the front of the bow). In particular embodiments, the attachment mechanism 802 may be threaded to facilitate a secure, threaded attachment to the bow 14.

After the bow stabilizing and shock dampening assembly 70 is attached to the bow 14, a user may move the sliding dampener assembly 820 relative to the dampener assembly support rack 810 until the sliding dampener assembly 820 is in a desired position relative to the dampener assembly support rack 810. To do this, the user simply slides the sliding dampener assembly 820 relative to the dampener assembly support rack 810 until the sliding dampener assembly 820 is in the desired position. The ridges 842 on the dampener support's first end portion 840, and the ridges 847 on the dampener support's second end portion 845 then cooperate to frictionally maintain the sliding dampener assembly 820 in place while the bow 14, or other weapon, is in use.

In particular embodiments, using this technique, the user may selectively slide the sliding dampener assembly 820 relative to the bow stabilizing and shock dampening assembly's elongated housing 800 to thereby adjust the distance between the bow 14 and the dampener 900 that is supported by the dampener support 830. In particular embodiments, the dampener support 830 and dampener assembly support rack 810 are adapted to cooperate to maintain the dampener 900 in a plane that is at least substantially parallel to a central axis of the bow stabilizing and shock dampening assembly 70 as the user slides the sliding dampener assembly 820 relative to the bow stabilizing and shock dampening assembly's elongated housing 800. Also, the dampener support 830 and dampener assembly support rack 810 may be adapted to cooperate to maintain the dampener 900 in a plane that is at least substantially parallel to a central axis of the bow stabilizing and shock dampening assembly 70 as the user slides the sliding dampener assembly 820 relative to the bow stabilizing and shock dampening assembly's elongated housing 80.

CONCLUSION

Many modifications and other embodiments of the invention will come to mind to one skilled in the art to which this invention pertains having the benefit of the teachings presented in the foregoing descriptions and the associated drawings. For example, while the dampeners described above are described as being generally circular, other shapes and sizes of dampeners (and dampener supports) may be used in other embodiments. As another example, while the elongated housing described above is discussed as being substantially planar, in other embodiments, the elongated housing may be non-planar.

As a further example, although the dampener assembly is described as being slideably attached to the support rack, the dampener assembly may, in other embodiments, be attached to the support rack in a way that allows users to reposition the dampener assembly relative to the support rack in a non-slideable manner. For example, the dampener assembly may be adapted to allow the user to selectively detach the dampener assembly from the support rack (e.g., without using tools) and then reattach the dampener assembly at a new location relative to the support rack.

Also, it should be understood that the techniques and structures described above may be used in contexts other than archery. For example, the stabilizing and dampening systems described herein may be attached to other types of weapons (e.g., firearms) to facilitate a more comfortable and accurate use of those weapons. Therefore, it is to be understood that the invention is not to be limited to the specific embodiments disclosed and that modifications and other embodiments are intended to be included within the scope of the appended exemplary concepts. Although specific terms are employed herein, they are used in a generic and descriptive sense only and not for the purposes of limitation.

What is claimed is:

1. A bow stabilizing and shock dampening assembly comprising:

a dampener support;

an elongated housing that is adapted for supporting said dampener support, wherein said elongated housing comprises:

a first end, a second end opposite the first end, and an opening that extends through the elongated housing transverse to a central axis that extends between the first and second ends, and an attachment mechanism that couples to the elongated housing second end that is adapted for selectively attaching said elongated housing adjacent a bow, wherein:

said dampener support is slideably received and retained in said opening by a peripheral edge of said dampener support so that a user may selectively slide said dampener support relative to said elongated housing toward and away from said elongated housing first and second ends to thereby adjust a distance between said bow and a dampener that is supported by said dampener support.

2. The bow stabilizing and shock dampening assembly of claim 1, wherein:

said dampener support is adapted to maintain a dampener in a plane that is at least substantially parallel to said central axis of said elongated housing.

3. The bow stabilizing and shock dampening assembly of claim 1, wherein:

said elongated housing comprises a dampener assembly support rack; and said dampener support is slideably attached to said dampener assembly support rack so that a user may selectively slide said dampener along a length of said dampener assembly support rack to thereby adjust a distance between said bow and a dampener that is supported by said dampener support.

4. The bow stabilizing and shock dampening assembly of claim 3, wherein:

said dampener assembly support rack is adapted to maintain a dampener in a plane that is at least substantially parallel to a said central axis of said elongated housing.

5. The bow stabilizing and shock dampening assembly of claim 3, wherein:

said dampener assembly support rack comprises:

a first elongated rail, and a second elongated rail that is spaced apart from, substantially parallel to, and co-facing said first elongated rail, and said dampener support is positioned between said first and second rails and is adapted to slide along a length of said first and second rails while remaining positioned between said first and second rails.

6. The bow stabilizing and shock dampening assembly of claim 5, wherein:

said first rail defines a first elongated groove;

said second rail defines a second elongated groove that is spaced apart from, and co-facing said first elongated groove;

said dampener support assembly defines a first projection that extends into said first groove;

said dampener support assembly defines a second projection that extends into said second groove;

said bow stabilizing and shock dampening assembly is adapted so that, as said dampener support slides relative to said dampener assembly support rack, said first projection slides within said first groove and said second projection slides within said second groove.

7. The bow stabilizing and shock dampening assembly of claim 6, wherein:

said first projection defines a first plurality of ridges adjacent its distal end;

said second projection defines a second plurality of ridges adjacent its distal end;

said first and second pluralities of ridges each engage a portion of said dampener assembly support rack; and said first and second pluralities of ridges cooperate to inhibit the passive movement of said dampener assembly relative to said dampener assembly support rack.

8. The bow stabilizing and shock dampening assembly of claim 7, wherein:

said dampener support assembly defines a dampener support; and said bow stabilizing and shock dampening assembly further comprises a dampener that is supported by said dampener support.

9. A weapon stabilizing and shock dampening assembly comprising:

a dampener support assembly;

a rack that is adapted for supporting said dampener support assembly adjacent a weapon, wherein:

said rack comprises:

a first end, an opposite second end that is configured to couple to said weapon, a central axis that extends between said first and second ends, and an opening that is formed through said rack transverse to said central axis, said opening is configured to allow said dampener support assembly to be received in said rack and slideably retained therein by a peripheral edge of said dampener support assembly, and said rack and dampener support assembly are adapted to allow a user to selectively reposition said dampener support assembly relative to said rack, and to thereby modify a distance between said weapon and a dampener supported by said dampener support assembly.

10. The weapon stabilizing and shock dampening assembly of claim 9, wherein:

said rack and dampener support assembly are adapted to allow a user to slide said dampener support assembly relative to said rack, and to thereby modify a distance between said weapon and a dampener supported by said dampener support assembly.

11. The weapon stabilizing and shock dampening assembly of claim 10, wherein:

said dampener assembly support rack is adapted to maintain a dampener in a plane that is at least substantially parallel to said central axis of said weapon stabilizing and shock dampening assembly.

12. The weapon stabilizing and shock dampening assembly of claim 10, wherein:

said dampener assembly support rack further comprises:

a first elongated rail, and a second elongated rail that is spaced apart from, substantially parallel to, and co-facing said first elongated rail, wherein said first and said second elongated rails that extends between said rack first and second ends, and said dampener support is positioned between said first and second rails and is adapted to slide along a length of said first and second rails while remaining positioned between said first and second rails.

13. The weapon stabilizing and shock dampening assembly of claim 12, wherein:

said first rail defines a first elongated groove;

said second rail defines a second elongated groove that is spaced apart from, and co-facing said first elongated groove;

said dampener support assembly defines a first projection that extends into said first groove;

said dampener support assembly defines a second projection that extends into said second groove; and said weapon stabilizing and shock dampening assembly is adapted so that, as said dampener support slides relative to said dampener assembly support rack, said first projection slides within said first groove and said second projection slides within said second groove.

14. The weapon stabilizing and shock dampening assembly of claim 13, wherein:

said first projection defines a first plurality of ridges adjacent its distal end;

said second projection defines a second plurality of ridges adjacent its distal end;

said first and second pluralities of ridges each engage a portion of said dampener assembly support rack; and said first and second pluralities of ridges cooperate to inhibit the passive movement of said dampener assembly relative to said dampener assembly support rack.

15. The weapon stabilizing and shock dampening assembly of claim 14, wherein:

said dampener support assembly defines a dampener support; and said weapon stabilizing and shock dampening assembly further comprises a dampener that is supported by said dampener support.

* * * * *